US009346285B2

(12) United States Patent
Rawlings et al.

(10) Patent No.: US 9,346,285 B2
(45) Date of Patent: May 24, 2016

(54) TWO-SIDED THERMAL PRINTER

(71) Applicant: NCR Corporation, Duluth, GA (US)

(72) Inventors: Timothy W. Rawlings, Waynesville, OH (US); Matthew A. McLaughlin, Franklin, OH (US); Jeffrey S. Denton, Springboro, OH (US); Richard D. Puckett, Miamisburg, OH (US); Yaoping A. Tan, Lebanon, OH (US); Paul C. Blank, LaCrosse, WI (US); Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/706,225

(22) Filed: May 7, 2015

(65) Prior Publication Data

US 2015/0231895 A1 Aug. 20, 2015

Related U.S. Application Data

(62) Division of application No. 11/779,732, filed on Jul. 18, 2007, now Pat. No. 9,056,488.

(51) Int. Cl.

| | |
|---|---|
| ***B41J 3/60*** | (2006.01) |
| ***B41J 2/325*** | (2006.01) |
| ***B41J 2/32*** | (2006.01) |
| ***B41J 3/01*** | (2006.01) |
| ***B41J 11/00*** | (2006.01) |

(52) U.S. Cl.

CPC .. *B41J 2/325* (2013.01); *B41J 2/32* (2013.01); *B41J 3/01* (2013.01); *B41J 3/60* (2013.01); *B41J 11/009* (2013.01); *B41J 11/0015* (2013.01)

(58) Field of Classification Search

USPC ..... 347/171; 400/82, 188

See application file for complete search history.

(56) References Cited

U.S. PATENT DOCUMENTS

| | | | |
|---|---|---|---|
| 3,466,423 | A | 9/1969 | Janning |
| 3,518,406 | A | 6/1970 | Janning |
| 3,663,390 | A | 5/1972 | Fergason et al. |
| 4,161,277 | A | 7/1979 | Steiner |
| 4,631,596 | A | 12/1986 | Yaguchi |
| 4,806,950 | A | 2/1989 | Sekine et al. |

(Continued)

FOREIGN PATENT DOCUMENTS

| | | | |
|---|---|---|---|
| CN | 1065536 | A | 2/1992 |
| EP | 0552956 | | 7/1993 |

(Continued)

OTHER PUBLICATIONS

Machine-generated translation of J P 08-169127, published on Jul. 1996.

*Primary Examiner* — Huan Tran

(74) *Attorney, Agent, or Firm* — Schwegman, Lungberg & Woessner

(57) ABSTRACT

Methods of, and apparatus for, two-sided thermal printing comprising direct and/or thermal transfer print means are provided. In one embodiment, a combined direct thermal and thermal transfer printer and related media are disclosed wherein direct thermal printing is provided for on a first media side, and thermal transfer printing is provided on a second media side. In other embodiments, various two-sided thermal transfer printers and media are disclosed wherein thermal transfer printing is provided for on first and second media sides through use of, inter alia, a one- and/or a two-sided thermal transfer ribbon.

19 Claims, 12 Drawing Sheets

(56) References Cited

U.S. PATENT DOCUMENTS

| | | | | |
|---|---|---|---|---|
| 4,853,256 | A | 8/1989 | Obringer et al. | |
| 4,924,275 | A | 5/1990 | Nelson | |
| 4,987,118 | A | 1/1991 | Murata et al. | |
| 5,130,292 | A | 7/1992 | Ito et al. | |
| 5,219,821 | A | 6/1993 | Arbee et al. | |
| 5,272,127 | A | 12/1993 | Mandoh et al. | |
| 5,319,392 | A | 6/1994 | Durst et al. | |
| 5,339,099 | A | 8/1994 | Nureki et al. | |
| 5,366,952 | A | 11/1994 | Granquist | |
| 5,476,698 | A | 12/1995 | Denny | |
| 5,537,550 | A | 7/1996 | Russell et al. | |
| 5,585,321 | A | 12/1996 | Breen et al. | |
| 5,686,159 | A | 11/1997 | Langan | |
| 5,688,057 | A | 11/1997 | Wright et al. | |
| 5,727,135 | A | 3/1998 | Webb | |
| 5,741,592 | A | 4/1998 | Lewis et al. | |
| 5,754,213 | A | 5/1998 | Whritenor | |
| 5,781,823 | A | 7/1998 | Isobe et al. | |
| 5,918,910 | A | 7/1999 | Stillwagon et al. | |
| 5,961,228 | A | 10/1999 | Ward et al. | |
| 5,980,128 | A | 11/1999 | Verlinden et al. | |
| 6,000,726 | A | 12/1999 | Campbell | |
| 6,000,867 | A | 12/1999 | Yoshii et al. | |
| 6,042,264 | A | 3/2000 | Prusik et al. | |
| 6,106,910 | A | 8/2000 | Tan et al. | |
| 6,118,956 | A | 9/2000 | Hirao | |
| 6,151,037 | A | 11/2000 | Kaufman et al. | |
| 6,165,937 | A | 12/2000 | Puckett et al. | |
| 6,197,722 | B1 | 3/2001 | Irving et al. | |
| 6,210,517 | B1 | 4/2001 | Eadara et al. | |
| 6,233,057 | B1 | 5/2001 | Ota | |
| 6,241,386 | B1 | 6/2001 | Limburg et al. | |
| 6,258,746 | B1 | 7/2001 | Mehta | |
| 6,267,052 | B1 | 7/2001 | Hill et al. | |
| 6,350,072 | B1 | 2/2002 | Nunes et al. | |
| 6,416,154 | B1 | 7/2002 | Silverbrook | |
| 6,523,951 | B2 | 2/2003 | Takeya et al. | |
| 6,543,808 | B1 | 4/2003 | Mitchell, Jr. et al. | |
| 6,544,709 | B1 | 4/2003 | Wang et al. | |
| 6,663,304 | B2 | 12/2003 | Vives et al. | |
| 6,705,786 | B2 | 3/2004 | Trovinger | |
| 6,737,137 | B2 | 5/2004 | Franko, Sr. et al. | |
| 6,759,366 | B2 * | 7/2004 | Beckerdite et al. | 503/200 |
| 6,786,263 | B1 | 9/2004 | Fox, Jr. et al. | |
| 6,803,344 | B2 | 10/2004 | Halbrook et al. | |
| 6,811,252 | B2 * | 11/2004 | Speich | 347/104 |
| 6,812,943 | B1 | 11/2004 | Day et al. | |
| 6,962,449 | B2 | 11/2005 | Lermant et al. | |
| 6,962,763 | B2 | 11/2005 | Maskasky et al. | |
| 6,982,737 | B2 | 1/2006 | Elko et al. | |
| 7,192,904 | B2 | 3/2007 | Iwasaki et al. | |
| 7,514,262 | B2 | 4/2009 | Ribi | |
| 7,520,586 | B2 | 4/2009 | Itoh | |
| 7,589,752 | B2 | 9/2009 | Janning | |
| 7,623,145 | B2 | 11/2009 | Taguchi | |
| 7,671,878 | B2 | 3/2010 | Yamada et al. | |
| 7,760,370 | B2 | 7/2010 | Oki | |
| 9,056,488 | B2 * | 6/2015 | Rawlings et al. | |
| 2001/0034775 | A1 | 10/2001 | Minowa | |
| 2002/0122188 | A1 | 9/2002 | Elko et al. | |
| 2002/0124950 | A1 | 9/2002 | Klima | |
| 2003/0025779 | A1 | 2/2003 | Miyazaki | |
| 2003/0031861 | A1 | 2/2003 | Reiter et al. | |
| 2003/0112318 | A1 * | 6/2003 | Long et al. | 347/171 |
| 2003/0208560 | A1 | 11/2003 | Inoue et al. | |
| 2004/0046971 | A1 | 3/2004 | Lapstun et al. | |
| 2004/0135872 | A1 | 7/2004 | Burdenko | |
| 2004/0265542 | A1 | 12/2004 | Yanagisawa et al. | |
| 2005/0031392 | A1 | 2/2005 | Yamamoto et al. | |
| 2005/0146739 | A1 | 7/2005 | Rayletal | |
| 2005/0146740 | A1 | 7/2005 | Fukuda | |
| 2005/0148467 | A1 | 7/2005 | Makitalo et al. | |
| 2005/0271866 | A1 | 12/2005 | Lee | |
| 2006/0072001 | A1 | 4/2006 | Klein | |
| 2006/0289633 | A1 * | 12/2006 | Moreland et al. | 235/381 |
| 2007/0109349 | A1 | 5/2007 | Tanaka et al. | |
| 2007/0207926 | A1 * | 9/2007 | Van Demark et al. | 503/226 |
| 2007/0211134 | A1 * | 9/2007 | VanDemark | 347/220 |
| 2007/0211135 | A1 * | 9/2007 | Moreland et al. | 347/221 |
| 2007/0213215 | A1 * | 9/2007 | Dashiell et al. | 503/226 |
| 2007/0223022 | A1 | 9/2007 | Suzuki | |
| 2009/0015649 | A1 * | 1/2009 | Keeton et al. | 347/217 |
| 2009/0184510 | A1 | 7/2009 | Frankel | |
| 2009/0195584 | A1 | 8/2009 | Itoh | |
| 2009/0225353 | A1 | 9/2009 | Ishibashi | |
| 2010/0225932 | A1 | 9/2010 | Kurose et al. | |

FOREIGN PATENT DOCUMENTS

| | | |
|---|---|---|
| EP | 1 862 318 | 5/2007 |
| EP | 1 862 319 | 5/2007 |
| JP | 58008668 | 1/1983 |
| JP | 58051172 | 5/1983 |
| JP | 03234560 | 10/1991 |
| JP | 03293171 | 12/1991 |
| JP | H07061141 | 8/1993 |
| JP | 06262786 | 9/1994 |
| JP | H09086041 | 9/1995 |
| JP | 08127152 | 5/1996 |
| JP | 2000315275 | 11/2000 |
| JP | 2001080131 | 3/2001 |
| JP | 09-183427 | 9/2004 |
| JP | 2006095755 | 4/2006 |
| RU | 2088969 | 8/1997 |
| WO | 02/096665 | 12/2002 |
| WO | 2007102879 | 9/2007 |

* cited by examiner

TWO-SIDED THERMAL PRINTER

CROSS REFERENCE TO RELATED APPLICATIONS

This application claims priority to U.S. Provisional Application No. 60/949,378 entitled "Two-Sided Thermal Printing" and filed on Jul. 12, 2007, the contents of which are hereby incorporated by reference herein.

BACKGROUND

Dual, or two-sided printing comprises the simultaneous or near simultaneous printing or imaging of a first side and a second side of print media, opposite the first side. Two-sided direct thermal printing of media comprising a document such as a transaction receipt is described in U.S. Pat. Nos. 6,784,906 and 6,759,366 the contents of which are hereby incorporated by reference herein. In two-sided direct thermal printing, a two-sided direct thermal printer is configured to allow concurrent printing on both sides of two-sided thermal media moving along a media feed path through the printer. In such printers a thermal print head is disposed on each of two sides of the media for selectively applying heat to one or more thermally sensitive coatings thereon. The coatings change color when heat is applied, by which printing is provided on the respective sides.

SUMMARY

In one embodiment, a combined direct thermal and thermal transfer printer and related media are disclosed wherein direct thermal printing is provided for on, for example, a first, direct thermally coated media side, and thermal transfer printing is provided on, for example, a second, thermal transfer receptive media side. In other embodiments, various two-sided thermal transfer printers and media are disclosed wherein thermal transfer printing is provided for on first and second media sides through use of, inter alia, a one- and/or a two-sided thermal transfer ribbon.

DETAILED DESCRIPTION

By way of example, various embodiments of the invention are described in the material to follow with reference to the included drawings. Variations may be adopted.

Figure 1:
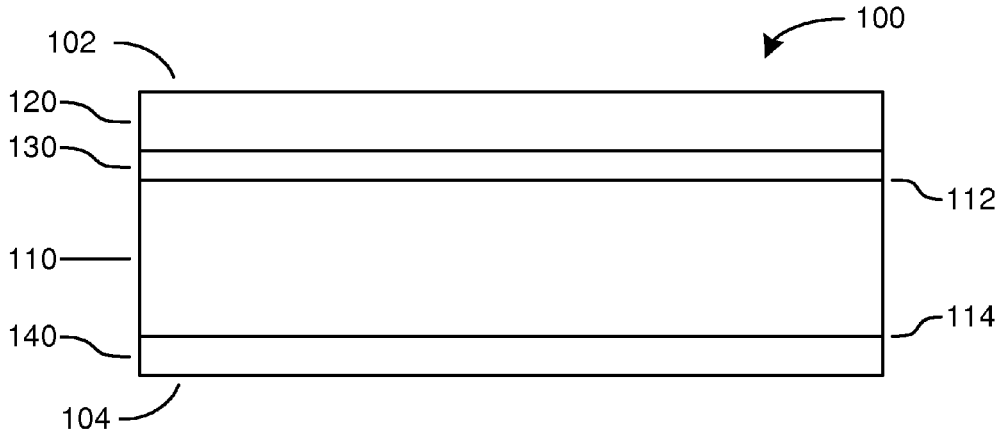
FIG. 1 provides a cross-sectional view of one-sided thermal transfer ribbon for, inter alia, thermal transfer printing of media such as transaction receipts, tickets, labels, and other documents.

FIG. 1 illustrates a one-sided thermal transfer ribbon 100 for thermal transfer printing of media such as transaction receipts, tickets, labels, and other documents. As shown in FIG. 1, a one-sided thermal transfer ribbon 100 may comprise a substrate 110 with a functional coat 120 on a first side 112 thereof and a back coat 114 on a second side thereof. The substrate 110 may comprise a fibrous or film type sheet for supporting the functional coating 120. Additionally, the substrate 110 may be natural (e.g., cellulose, cotton, starch, and the like) or synthetic (e.g., polyethylene, polyester, polypropylene, and the like). In one embodiment, the substrate 110 is provided in the form of an 18 gauge polyethylene terephthalate (PET) film.

A functional coating 120 of a one-sided thermal transfer ribbon 100 may comprise a dye and/or pigment bearing substance which is transferred to receptive media (e.g., cardboard, paper, film, and the like) upon application of heat, by which printing is provided. A functional coating 120 may comprise a wax (e.g., carnauba, paraffin, and the like), resin (e.g., urethane, acrylic, polyester, and the like), or a combination of the two, having one or more dyes (e.g., a leuco dye, methyl violet, and the like) and/or pigments (e.g., carbon black, iron oxide, inorganic color pigments, and the like) incorporated therein. In one embodiment, a functional coating 120 comprising 65-85% carnauba and/or paraffin wax, 5-20% carbon black pigment, and 5-15% ethylene vinyl acetate (EVA) resin is provided. In a further embodiment, a functional coating 120 comprising 40% carnauba, 40% paraffin wax, 15% carbon black pigment, and 5% ethylene vinyl acetate (EVA) resin is provided Where applied, a back coat 140 of a one-sided thermal transfer ribbon 100 may protect the substrate 110 from damage due to application of heat for printing (e.g., warping, curling, melting, burn-thru, and the like), mitigate against bonding of a functional coated side 102 of a one-sided thermal transfer ribbon 100 to a back side 104 thereof when such ribbon 100 is provided in, for example, roll form, and/or provide a low friction (re. slippery) surface to ease travel over and mitigate damage to an associated print head.

A typical back coat 140 is silicone and/or silane based (either mobile or cured), which provides desired thermal stability under print (re. hot) conditions, and a low coefficient of friction (re. slippery). In one embodiment, a back coat 140 comprises a water based or ultra-violet (UV) light cured silicone.

As further shown in FIG. 1, a one-sided thermal transfer ribbon may further comprise a sub coat 130 between the substrate 110 and the functional coating 120. Where provided, the sub coat 130 may aid in adhering and/or releasing the functional coating 120 to and/or from the substrate 110. A sub coat 130 may comprise a wax (e.g., carnauba, paraffin, and the like), resin (e.g., urethane, acrylic, polyester, and the like), or a combination of the two, and may include one or more release and/or slip agents (e.g., polytetrafluoroethylene (PTFE), silicone, and the like). In one embodiment, a sub coat 130 comprises 60% carnauba wax, 30% paraffin wax, and 10% PTFE.

Figure 2:
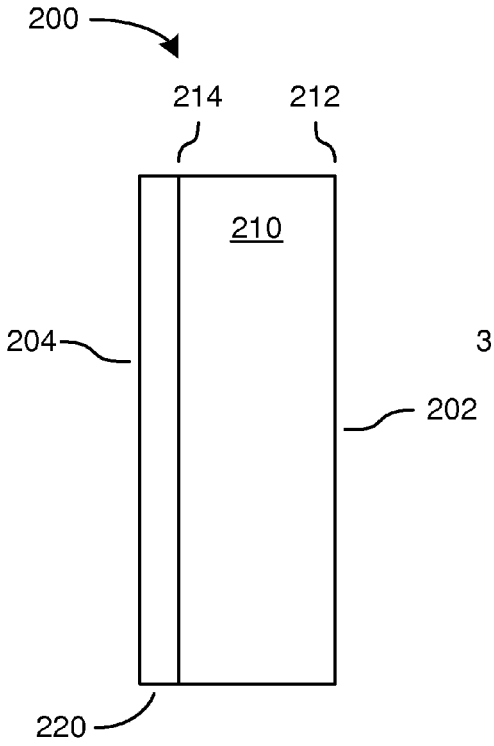
FIG. 2 provides a cross-sectional view of one-sided thermal transfer media for use as, inter alia, a transaction receipt, ticket, label, or other document.

FIG. 2 illustrates one-sided thermal transfer media 200 for use as a transaction receipt, ticket, label, or other document. As shown in FIG. 2, one-sided thermal transfer media 200 may comprise a substrate 210 supporting a thermal transfer receptive coating 220 on a first side 214 thereof. The substrate 210 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 210 is provided in the form of a non-woven cellulosic (e.g., paper) sheet.

The thermal transfer receptive coating 220 of one-sided thermal transfer media 200 may comprise one or more materials for preparing a respective printing surface 204 of the media 200 to accept transfer of a functional coating 120 from a thermal transfer ribbon 100. Such thermal transfer receptive coating 220 may comprise a clay (e.g., kaolinite, montmorillonite, illite, and chlorite), resin (e.g., urethane, acrylic, polyester, and the like), or a combination thereof, with or without a binder (e.g., polyvinyl acetate (PVA)), which coating 220 may further be prepared to a desired or required surface finish and/or smoothness post-application. In one embodiment, a thermal transfer receptive coating 220 comprising 90% clay and 10% PVA (as-dried) calendared to a smoothness of greater than approximately 300 Bekk seconds is provided on a first side 214 of a non-woven cellulosic substrate 210 comprising one-sided thermal transfer media 200.

Figure 3:
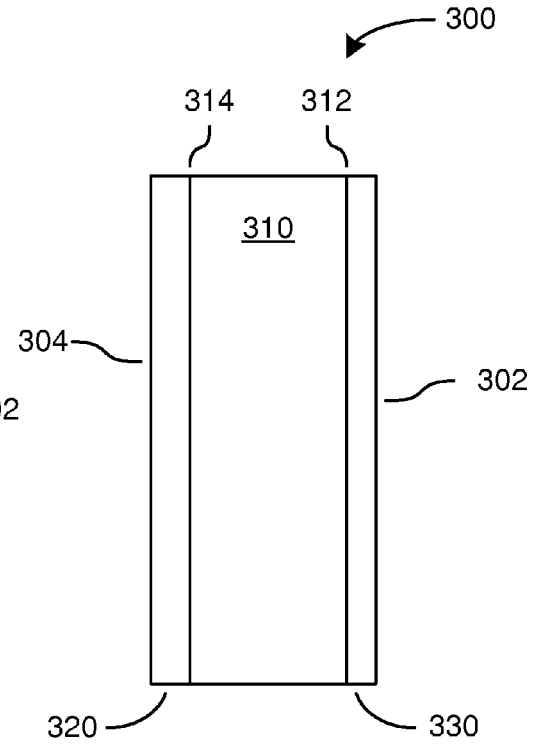
FIG. 3 provides a cross-sectional view of two-sided thermal transfer media for use as, inter alia, a transaction receipt, ticket, label, or other document.

FIG. 3 illustrates two-sided thermal transfer media 300 for use as, for example, a one- or two-sided transaction receipt, ticket, label, or other document. As shown in FIG. 3, two-sided thermal transfer media 300 may comprise a substrate 310 supporting a thermal transfer receptive coating 320 on a first side 314 thereof. The substrate 310 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 310 is provided in the form of a biaxially-oriented polypropylene (BOPP) sheet.

The thermal transfer receptive coatings 320, 330 of the two-sided thermal transfer media 300 may comprise one or more materials for preparing a respective printing surface 302, 304 of the media 300 to accept transfer of a functional coating 120 from a thermal transfer ribbon 100. Such coatings 320, 300 may comprise a clay (e.g., kaolinite, montmorillonite, illite, and chlorite), resin (e.g., urethane, acrylic, polyester, and the like), or a combination thereof, either or both of which coatings 320, 330 may further be prepared to a desired or required surface finish and/or smoothness post-application. In one embodiment, thermal transfer receptive coatings 320, 330 each comprising 100% acrylic and calendared to a smoothness of greater than approximately 300 Bekk seconds are provided on respective sides 314, 312 of a BOPP substrate 310 comprising the two-sided thermal transfer media 300.

Figure 4:
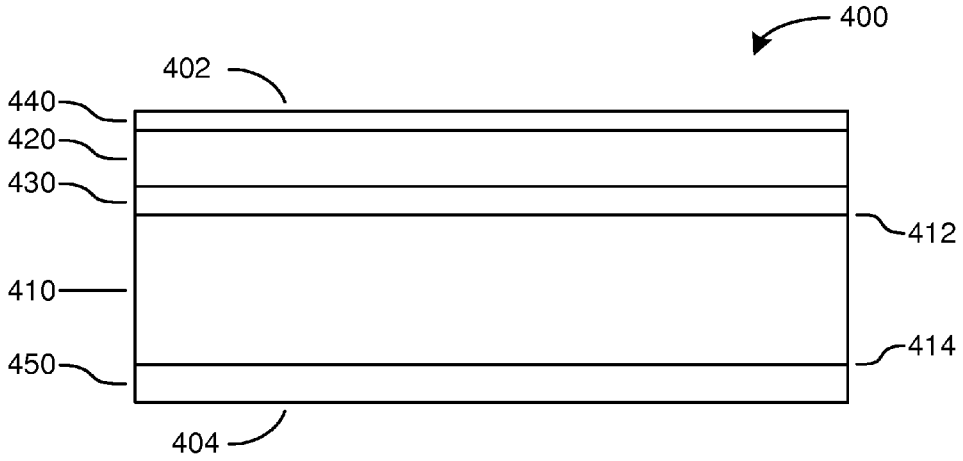
FIG. 4 provides a cross-sectional view of one-sided direct thermal media for use as, inter alia, a transaction receipt, ticket, label, or other document.

FIG. 4 illustrates a cross-sectional view of one-sided direct thermal media 400 for use as a transaction receipt, ticket, label, or other document. As shown in FIG. 4, one-sided direct thermal media 400 may comprise a substrate 410 having a thermally sensitive coating 420 on a first side 412 thereof. As for the one-sided thermal transfer media 200 illustrated in FIG. 2, the substrate 410 of one-sided direct thermal media may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 410 is provided in the form of a non-woven cellulosic (e.g., paper) sheet.

A thermally sensitive coating 420 may comprise at least one dye and/or pigment, and optionally, may include one or more activating agents which undergo a color change upon the application of heat by which printing is provided. In one embodiment, a dye-developing type thermally sensitive coating comprising a leuco-dye (e.g., 3,3-bis(p-dimethylaminophenyl)-phthalide, 3,3-bis(p-dimethylaminophenyl)-6-dimethylaminophthalide, 3-cyclohexylamino-6-chlorofluoran, 3-(N—N-diethylamino)-5-methyl-7-(N,N-Dibenzylamino)fluoran, and the like), a developer (e.g., 4,4'-isopropylene-diphenol, p-tert-butylphenol, 2-4-dinitrophenol, 3,4-dichiorophenol, p-phenylphenol, 4,4-cyclohexylidenediphenol, and the like), and an optional sensitizer (e.g., acetamide, stearic acid amide, linolenic acid amide, lauric acid amide, and the like) as disclosed in U.S. Pat. No. 5,883,043 to Halbrook, Jr., et al. the contents of which are hereby incorporated by reference herein, is provided.

As further illustrated in FIG. 4, one-sided direct thermal media 400 may further comprise a sub coat 430, a top coat 440 and a back coat 450. Where provided, a sub coat 430 may be included as a buffer region between a first surface 412 of a substrate 410 and a thermally sensitive coating 420 to avoid adverse interaction of chemicals and/or impurities from the substrate 410 with the thermally sensitive coating 420, and thereby avoid undesired and/or premature imaging. Further, a sub coat 430 may be provided to prepare an associated surface 412 of a substrate 410 for reception of a thermally sensitive coating 420, such as by providing for a desired or required surface finish or smoothness. Suitable sub coats 430 include clay and/or calcium carbonate based coatings. In one embodiment, a clay based sub coat 430 is applied to a first surface of a cellulosic substrate 410 and calendared to a smoothness of greater than approximately 300 Bekk seconds prior to application of an associated thermally sensitive coating 420 comprising one or more leuco dyes, developers and sensitizers.

A top coat 440 may be provided over a thermally sensitive coating 420 to protect the thermally sensitive coating and/or any resultant image from mechanical (e.g., scratch, smudge, smear, and the like) and/or environmental (chemical, UV, and the like) degradation. Likewise, a top coat 440 may be provided to enhance slip between the thermally sensitive coated side 102 of one-sided thermal media 400 and various components of a thermal printer such as, but not limited to a thermal print head. A top coat 440 may include any suitable components that serve to protect or enhance the performance and/or properties of a thermally sensitive layer 420 such as one or more polymers, monomers, UV absorbers, scratch inhibitors, smear inhibitors, slip agents, and the like. In one embodiment, a top coat 440 comprising a zinc stearate is provided over a thermally sensitive coating 420 in the form of a leuco dye/developer system.

One-sided direct thermal media 400 may further comprise a back coat 450 on a second side 414 of a substrate 410 to, inter alia, mitigate against mechanical and/or environmental damage to the substrate 410 and/or thermally sensitive coating 420, as well as provide for desirable mechanical and/or physical properties (e.g., slip, release, tear, adhesive, permeability, water resistance, UV absorbing, smoothness, and the like). In one embodiment, a calcium carbonate based back coat 450 is provided for acceptance of ink jet printing thereon.

Figure 5:
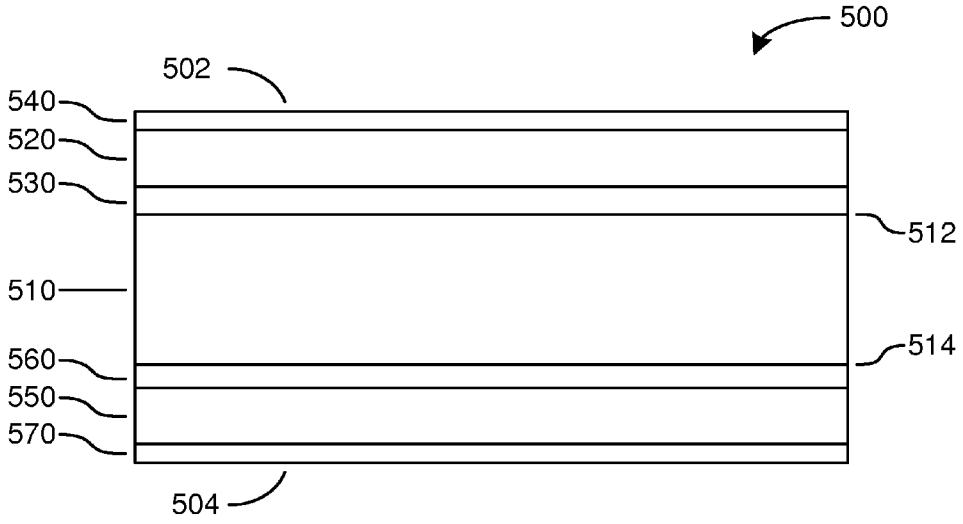
FIG. 5 provides a cross-sectional view of two-sided direct thermal media for use as, inter alia, a transaction receipt, ticket, label, or other document.

FIG. 5 illustrates a cross-sectional view of two-sided direct thermal media 500 for use as a transaction receipt, ticket, label, or other document. As shown in FIG. 5, two-sided direct thermal media 500 may comprise a substrate 510 having a first and a second thermally sensitive coating 520, 550 on a first and a second side 512, 514 thereof. As for one-sided direct thermal media 400, the substrate 510 of two-sided direct thermal media 500 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 510 is provided in the form of a spunbonded high density polyethylene sheet.

The thermally sensitive coating 520, 550 may comprise at least one dye and/or pigment, and optionally, may include one or more activating agents which undergo a color change upon the application of heat by which printing is provided. In one embodiment, dye-developing type thermally sensitive coatings 520, 550 comprising one or more leuco-dyes, developers, and, optionally, one or more sensitizers, as described hereinabove, are provided.

As further illustrated in FIG. 5, two-sided direct thermal media 500 may further comprise a sub coat 530, 560 between a first and a second surface 512, 514 of a substrate 510 and a respective first and second thermally sensitive coating 520, 550 in order to, inter alia, avoid adverse interaction of chemicals and/or impurities from the substrate 510 with the thermally sensitive coatings 520, 550. Additionally, one or more sub coats 530, 560 may be provided to prepare an associated surface 512, 514 of a substrate 510 for reception of a respective thermally sensitive coating 520, 550 such as by providing for a desired or required surface finish or smoothness. Suitable sub coats 530, 550 include clay and/or calcium carbonate based coatings. In one embodiment, clay based sub coats 530, 560 are applied to respective first and second surfaces 512, 514 of a spunbonded high density polyethylene substrate 510, and calendared to a smoothness of greater than approximately 300 Bekk seconds prior to application of associated thermally sensitive coatings 520, 550 comprising one or more leuco dyes, developers and sensitizers.

Finally, as additionally shown in FIG. 5, two-sided direct thermal media 500 may comprise one or more top coats 540, 570 over respective thermally sensitive coatings 520, 550 in order to, inter alia, protect the thermally sensitive coating and/or any resultant image from mechanical (e.g., scratch, smudge, smear, and the like) and/or environmental (chemical, UV, and the like) degradation. Likewise, one or more top coats 540, 570 may be provided to enhance slip between a respective side 502, 504 of two-sided thermal media 500 and various components of a thermal printer such as, but not limited to respective thermal print heads. A top coat 540, 570 may include any suitable components that serve to protect or enhance the performance and/or properties of a thermally sensitive layer 520, 550 such as one or more polymers, monomers, UV absorbers, scratch inhibitors, smear inhibitors, slip agents, and the like. In one embodiment, first and second top coats 540, 570 comprising varnish are provided over first and second thermally sensitive coatings 520, 550 in the form of leuco dye/developer systems comprising two-sided direct thermal media 500.

Depending on the application, a first thermally sensitive coating 520 may have a dye and/or co-reactant chemical which activates at a different temperature than the dye and/or co-reactant chemical present in the second coating 550. Alternatively or additionally, a substrate 510 of two-sided direct thermal media 500 may have sufficient thermal resistance to prevent heat applied to one coating 520, 550 from activating the dye and/or co-reactant chemical in the other coating 550, 520, as disclosed in U.S. Pat. No. 6,759,366 to Beckerdite et al. the contents of which are hereby incorporated herein by reference.

Figure 6A:
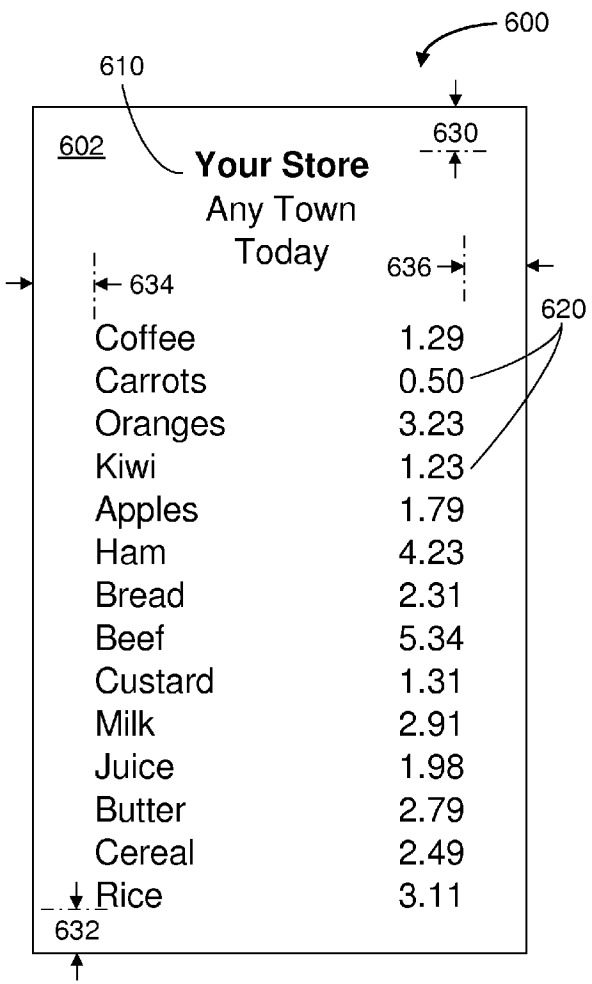
FIG. 6A illustrates a first side of a two-sided thermal document in the form of a transaction receipt.
Figure 6B:
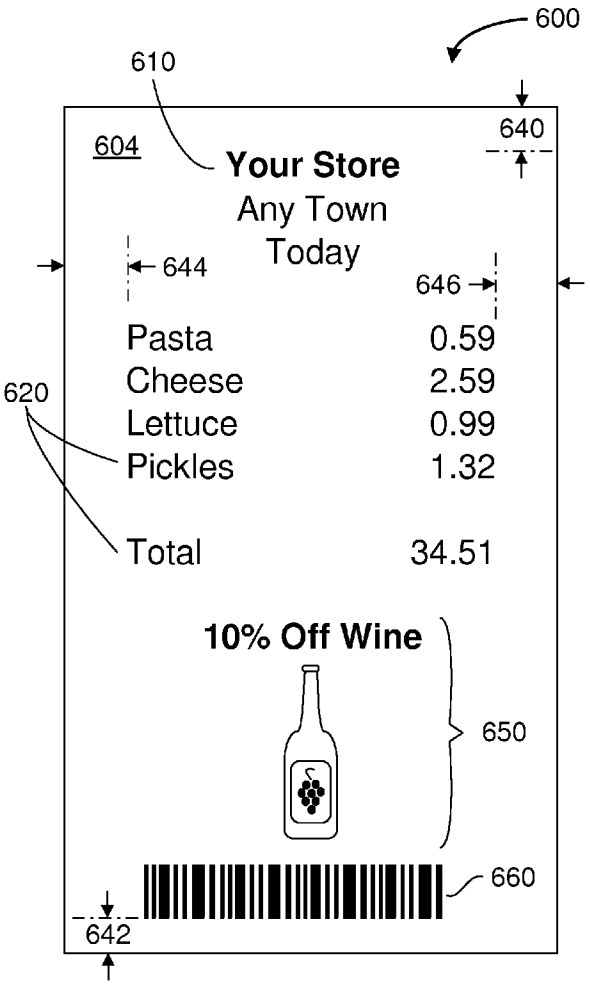
FIG. 6B illustrates a second side of a two-sided thermal document in the form of a transaction receipt.

FIGS. 6A and 6B illustrate respective first and second sides 602, 604 of a two-sided thermal document in the form of a transaction receipt 600. As shown in FIGS. 6A and 6B, a two-sided receipt 600 may comprise a header 610 printed on one or both sides 602, 604 of the receipt 600, along with respective first and second portions of transaction information 620 comprising the receipt 600.

Additionally, one or both sides 602, 604 of a two-sided receipt 600 may comprise additional text and/or graphic information desired or required to be printed such as, but not limited to, one or more of a logo, a serialized cartoon, a condition of sale, an advertisement, a security feature, rebate or contest information, ticket information, legal information such as a disclaimer or a warranty, and the like. As shown in FIG. 6B, such additional information may comprise a discount offer 650 and a bar code 660.

As further shown in FIGS. 6A and 6B, a first side 602 of a two-sided receipt 600 may further comprise a top margin 630, a bottom margin 632, a left margin 634, and a right margin 636. Likewise, a second side 604 of a two-sided receipt 600 may further comprise a top margin 640, a bottom margin 642, a left margin 644, and a right margin 646, some or all of which may also be the same size as, or independently sized in regard to the respective margins 630, 632, 634, 636 provided on the first side 602 of the two-sided receipt 600.

Figure 7:
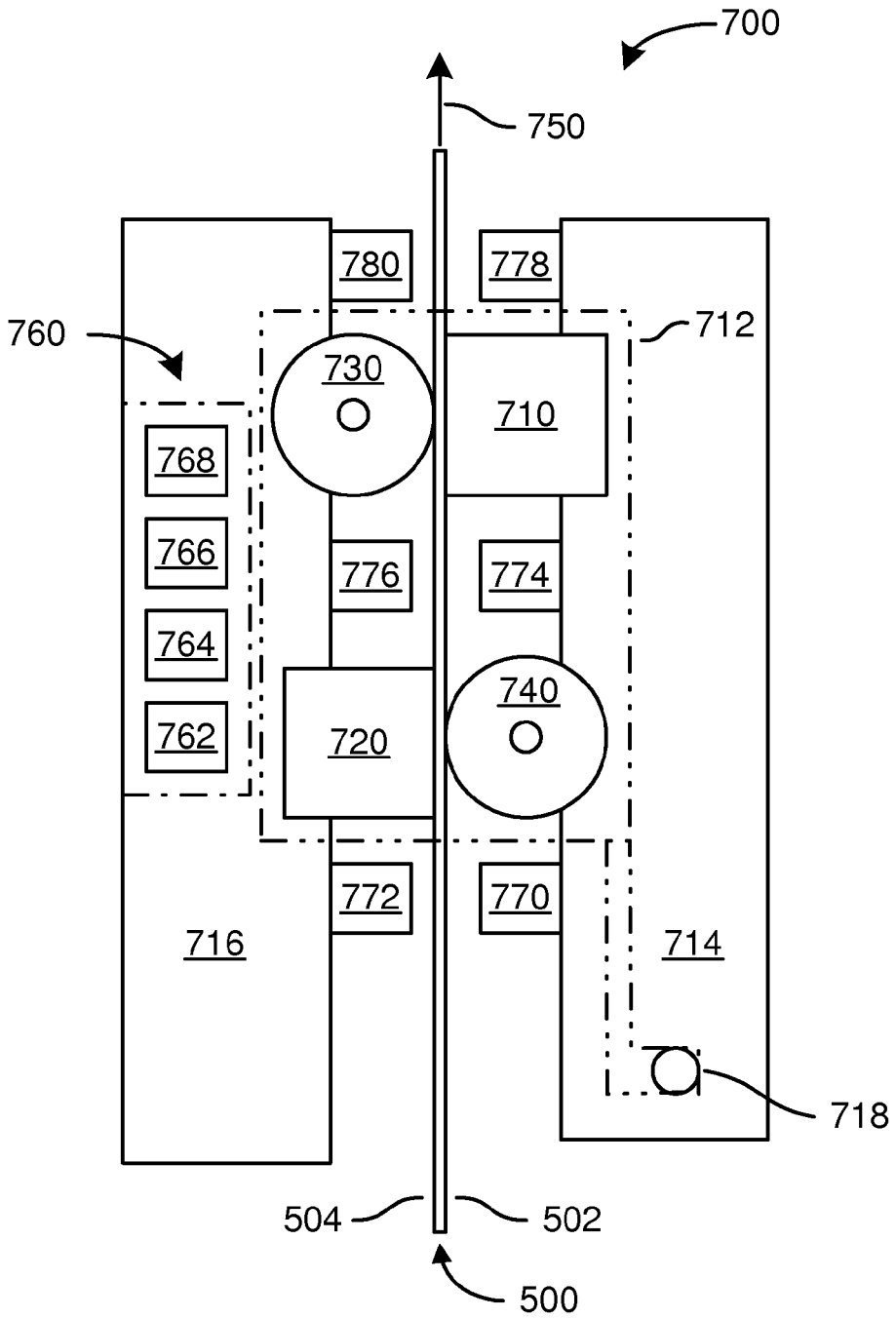
FIG. 7 provides a schematic of a two-sided direct thermal printer.

FIG. 7 illustrates a two-sided direct thermal printer 700 for direct thermal printing of direct thermal media such as the one- or two-sided direct thermal media 400, 500 of FIGS. 4 and 5. As shown in FIG. 7, a two-sided direct thermal printer 700 may comprise first and second thermal print heads 710, 720 for printing on respective sides 402, 502, 504 of one- or two-sided media 400, 500 moving along a media feed path 750. Additionally, first and second platens 730, 740 may be provided on opposite sides of the media 400, 500 and feed path 750 thereof proximate to the first and second print heads 710, 720 in order to, for example, maintain contact between the first and second print heads 710, 720 and a respective first and second side 402, 404, 502, 504 of the media 400, 500.

Depending on the printer design and/or application, the media 400, 500 may be supplied in the form of a roll, fan-fold stock, individual (cut) sheets, and the like, upon which information in text and/or graphic form may be printed on one or both sides thereof to provide, for example, a voucher, coupon, receipt, ticket, label or other article or document. In one embodiment, a two-sided direct thermal printer 700 comprises first and second thermal print heads 710, 720, and first and second rotating platens 730, 740 to facilitate printing on one or both sides of one- or two-sided direct thermal media 400, 500 provided in roll form, such as a model 7168 two-sided multifunction printer sold under the RealPOS trademark by NCR Corporation.

As shown in FIG. 7, a two-sided direct thermal printer 700 may further include a controller 760 for controlling operation of the printer 700. The controller 760 may comprise a communication controller 762, one or more buffers or memory elements 764, a processor 766, and/or a printing function switch 768. The communication controller 762 may provide for receiving and/or sending print commands and/or data to and from a host computer or terminal such as a point-of-sale (POS) terminal (not shown), an automated teller machine (ATM) (not shown), a self-checkout system (not shown), a personal computer (not shown), and the like, associated with the printer 700. The communications controller 762 may provide for input of data to, or output of data from, the printer 700 pursuant to one or more wired (e.g., parallel, serial/USB, Ethernet, etc) and/or wireless (e.g., 802.11, 802.15, IR, etc) communication protocols, among others.

Where provided, the one or more buffers or memory elements 764 may provide for short or long term storage of received print commands and/or data. As such, the one or more buffer or memory elements 764 may comprise one or more volatile (e.g., dynamic or static RAM) and/or non-volatile (e.g., EEPROM, flash memory, etc) memory elements. In one embodiment, a two-sided direct thermal printer 700 includes a first and a second memory element or storage area 764 wherein the first memory element or storage area 764 is adapted to store data identified for printing by one of the first and the second thermal print heads 710, 720, while the second memory element or storage area 764 is adapted to store data identified for printing by the other of the first and the second thermal print heads 710, 720.

In a further embodiment, a two-sided direct thermal printer 700 may additionally include a third memory element or storage area 764 in the form of a received print data storage buffer adapted to store data received by the printer 700 for printing by a first and/or a second thermal print head 710, 720 through use of, for example, a communication controller 762. Data from the received print data storage buffer 764 may, then, be retrieved and processed by a processor 766 associated with the printer 700 in order to, for example, split the received print data into a first data portion for printing on a first side of two-sided direct thermal print media 500 by a first thermal print head 710, and a second data portion for printing on a second side of the two-sided direct thermal print media 500 by a second thermal print head 720. Once a split determination has been made, such first and second data portions may, in turn, be stored in respective first and second memory elements or storage areas 764 in preparation for printing by the respective first and second print heads 710, 720.

In still another embodiment, a two-sided direct thermal printer 700 may include one or more predefined memory elements or storage areas 764 for storage of predefined print data comprising, for example, one or more of a coupon or other discount 650, a logo or header 610, a serialized cartoon, a condition of sale, a graphic or other image such as a bar code 660, an advertisement, a security feature, rebate or contest information, ticket information, legal information such as a disclaimer or a warranty, shipping—including origin and destination—information, and the like. Such stored, predefined print data may then be selected for printing on one or both sides of one- or two-sided direct thermal media 400, 500 along with, or separately from, any received print data, such as transaction data from a POS terminal (not shown) associated with the two-sided direct thermal printer 700.

Selection of predefined print data for printing may be provided for though use of, for example, a printing function switch 768 associated with a two-sided direct thermal printer 700. In addition to selecting predefined and/or other received print data for printing on a first and/or a second side 402, 502, 504 of direct thermal media 400, 500, such a switch 768 may enable activation and/or deactivation of one or more printing modes or functions provided for by the printer 700 such as one or more of a single-sided print mode, a double-sided with single-side command mode, a double-sided with double-side command mode, and a double-sided print mode with predefined data, as described in U.S. patent application Ser. No. 11/675,649 entitled "Two-Sided Thermal Print Switch" and filed on Feb. 16, 2007 the contents of which are hereby incorporated by reference herein.

A two-sided printing function switch 768 may be a mechanically operated switch in or on a two-sided direct thermal printer 700, or an electronic or software switch operated by a printer driver executed on an associated host computer, or by firmware or software resident on the printer 700, and the like. The switch 768 may, for example, be electronically operated in response to a command message or escape sequence transmitted to the printer 700. Printer control language or printer job language ("PCL/PJL"), or escape commands, and the like, may be used. A printer setup configuration program setting, e.g., a setting made through a software controlled utility page implemented on an associated host computer, could also electronically operate a switch 768 of a two-sided printer 700.

A two-sided printing function switch 768 of a two-sided printer 700 may be configured, programmed or otherwise setup to select or otherwise identify (1) data for printing (e.g., internally stored predefined data, externally received transaction data, and the like), (2) which of a first and a second print head 710, 720 will be used to print and/or be used to print particular portions of the selected data, (3) whether data selected for printing is to be printed when the media 400, 500 is moving in a first (e.g., forward) or a second (e.g., backward) direction, (4) in which relative and/or absolute media location, including on which media side 402, 502, 504, particular data will be printed, (5) in which orientation (e.g., rightside-up, upside-down, angled, and the like) particular data will be printed on the media 400, 500, (6) where to split selected data for printing by a first and a second print head 710, 720, and the like.

For example, in one embodiment, a setting of a two-sided printing function switch 768 may marshal a first data portion comprising approximately one half of selected print data for printing on a first (e.g., front) side 502 of two-sided direct thermal media 500, and a second data portion comprising approximately the remaining half of the selected print data for printing on a second (e.g., reverse) side 504 of the media 500. As previously described, such selected print data may comprise data received by the printer 700 from a host computer such as a POS terminal (not shown), an ATM (not shown), a self-checkout system (not shown), a personal computer (not shown) and the like, and/or predefined data stored in one or more memory or buffer locations 764 of the printer 700. In this manner a document such as a transaction receipt 600 may be generated in which a first portion of the selected data is printed on a first side 602 of the receipt and a second portion comprising the remaining selected data is printed on a second side 604 of the receipt, conserving upon the amount of media 500 required for printing the selected data.

In further reference to FIG. 7, a two-sided direct thermal printer 700 may also include first and second support arms 714, 716. The first support arm 714 may further be journaled on an arm shaft 718 to permit it to pivot or rotate in relation to the second support arm 716 in order to, for example, facilitate access to, and servicing of, the two-sided direct thermal printer 700, including loading of one- or two-sided direct thermal media 400, 500 therein. In alternate embodiments, the first and second support arms 714, 716 may be in a fixed relation to one another.

As further illustrated in FIG. 7, a first thermal print head 710 and a second platen 740 may be coupled to or formed integrally with a first support arm 714, while a second thermal print head 720 and a first platen 730 may be coupled to or formed integrally with a second support arm 716. In alternate embodiments (not shown), a first thermal print head 710 and a first platen 730 may be coupled to or formed integrally with a first support arm 714 while a second thermal print head 740 and a second platen 720 may be coupled to or formed integrally with a second support arm 716. Additional variations in component design and/or configuration, including a two-sided direct thermal printer 700 designs wherein a first and a second thermal print head 710, 720, and a first platen 730 are coupled to or formed integrally with a second arm 716 while a second platen 740 is coupled to or formed integrally with a first support arm 714, or a first and a second thermal print head 710, 720 and a first and a second platen 730, 740 are coupled to or formed integrally with a first or a second arm 714, 716, and the like, are also possible.

A two-sided direct thermal printer 700 may further include a drive system 712 for transporting media, such as one- or two-sided thermal media 400, 500, through the printer 700 during a print process. A drive system 712 may comprise one or more motors (e.g. stepper, servo, and the like) (not shown) for powering a system of gears, links, cams, belts, wheels, pulleys, rollers, combinations thereof, and the like. In one embodiment, a drive system 712 comprising a stepper motor and one or more gears adapted to rotate one or both of a first and a second platen 730, 740 each provided in the form of a circular cylinder is provided to transport media 400, 500 through the two-sided direct thermal printer 700. In alternate embodiments, a drive system 712 comprising a stepper motor operatively connected to one or more dedicated drive (e.g., non-platen) rollers (not shown) may be provided.

Figure 8:
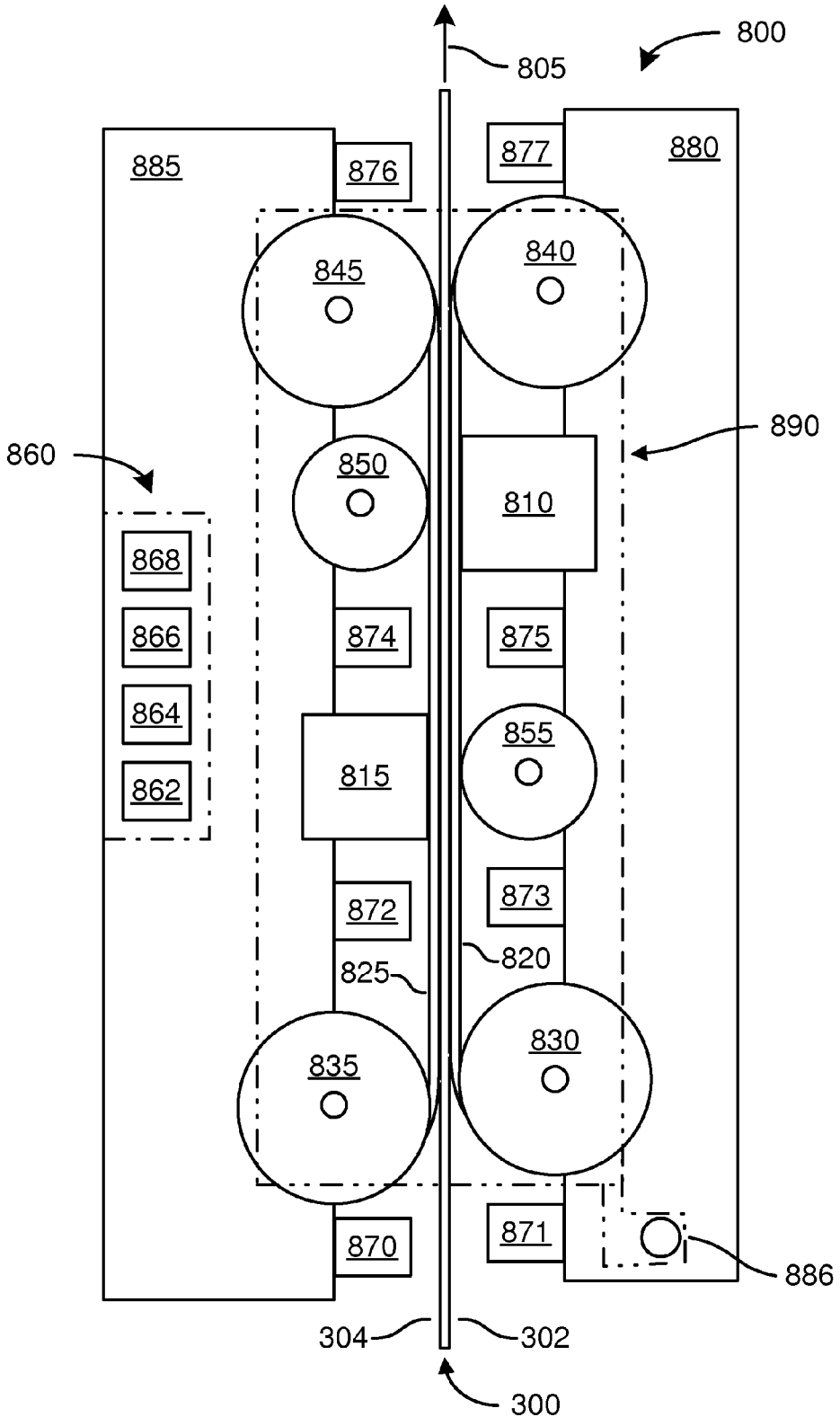
FIG. 8 provides a schematic of a two-sided thermal transfer printer.

FIG. 8 illustrates a two-sided thermal transfer printer 800 for thermal transfer printing of one or both sides of media such as the one- or two-sided thermal transfer media 200, 300 of FIGS. 2 and 3. As shown in FIG. 8, a two-sided thermal transfer printer 800 may comprise first and second thermal print heads 810, 815 for printing on respective first and/or second sides 202, 204, 302, 304 of one- or two-sided media 200, 300 moving along a media feed path 805. Additionally, first and second platens 850, 855 may be provided on opposite sides of the media 200, 300 and feed path 805 thereof proximate to the first and second print heads 810, 815 in order to, for example, maintain contact between the first and second print heads 810, 815 and a respective first and second side 202, 204, 304, 302 of the media 200, 300.

Depending on the printer design and/or application, print media such as the one- or two-sided thermal transfer media 200, 300 of FIGS. 2 and 3 may be supplied in the form of a roll, fan-fold stock, individual (cut) sheets, and the like, upon which information in text and/or graphic form may be printed on one or both sides 202, 204, 302, 304 thereof to provide, for example, a voucher, coupon, receipt, ticket, label, or other article or document. It should be noted that, unlike with direct thermal printing, it may be possible to print on a side 202 of media 200 absent inclusion of any specific thermal transfer receptive coating 220, 320, 330 using a two-sided thermal transfer printer 800, however print quality and/or longevity, and the like, may be affected.

As shown in FIG. 8, a two-sided thermal transfer printer 800 may additionally comprise first and second thermal transfer ribbons 820, 825 for providing functional thermal transfer coatings 120 for thermal transfer printing on respective first and second sides 202, 204, 302, 304 of one- or two-sided thermal transfer media 200, 300. Such first and second ribbons 820, 825 may be supported on first and second supply 830, 835 and take-up/rewind 840, 845 reels or supports within the printer 800, which reels or supports may additionally maintain a desired or required tension on the respective ribbons 820, 825 during a print process.

In further reference to FIG. 8, a two-sided thermal transfer printer 800 may also include first and second support arms 880, 885. The first support arm 880 may further be journaled on an arm shaft 886 to permit it to pivot or rotate in relation to the second support arm 885 in order to, for example, facilitate access to, and servicing of, the two-sided thermal transfer printer 800, including loading of one- or two-sided thermal transfer media 200, 300, and/or thermal transfer ribbons 100 therein. In alternate embodiments, the first and second support arms 880, 885 may be in a fixed relation to one another.

As further illustrated in FIG. 8, a first thermal print head 810, a second platen 855, and a first supply and take-up reel or support 830, 840 may be coupled to or formed integrally with a first support arm 880, while a second thermal print head 815, a first platen 850, and a second supply and take-up reel or support 830, 840 may be coupled to or formed integrally with a second support arm 885. Variations are also possible.

A two-sided thermal transfer printer 800 may further include a drive system 890 for transporting media, such as one- or two-sided thermal transfer media 200, 300, and/or first and second thermal transfer ribbons 820, 825 through the printer 800 and/or across one or both of the thermal print heads 810, 815 during a print process. Depending on the design and/or application, a drive system 890 may comprise one or more motors (e.g. stepper, servo, and the like) (not shown) for powering a system of gears, links, cams, belts, wheels, pulleys, rollers, combinations thereof, and the like. In one embodiment, a drive system 890 comprising a stepper motor and one or more gears adapted to rotate one or both of a first and a second platen 850, 855 each provided in the form of a circular cylinder is provided to transport media 200, 300 through the two-sided thermal transfer printer 800. In alternate embodiments, a drive system 890 comprising a stepper motor operatively connected to one or more dedicated drive (e.g., non-platen) rollers (not shown), and/or one or both of the ribbon 820, 825 supply 830, 835 and/or take-up 840, 845 rollers may be provided.

As shown in FIG. 8, a two-sided thermal transfer printer 800 may further include a controller 860 for controlling operation of the printer 800. Like the controller 760 of the two-sided direct thermal printer 700 of FIG. 7, the controller 860 of a two-sided thermal transfer printer such as the two-sided thermal transfer printer 800 of FIG. 8 may comprise a communication controller 862, one or more buffers or memory elements 864, a processor 866, and/or a printing function switch 868, each of which may perform one or more functions and/or operations consistent with the counterpart components 762, 764, 766, 768 of the two-sided direct thermal printer 700 of FIG. 7 described hereinabove.

Figure 9:
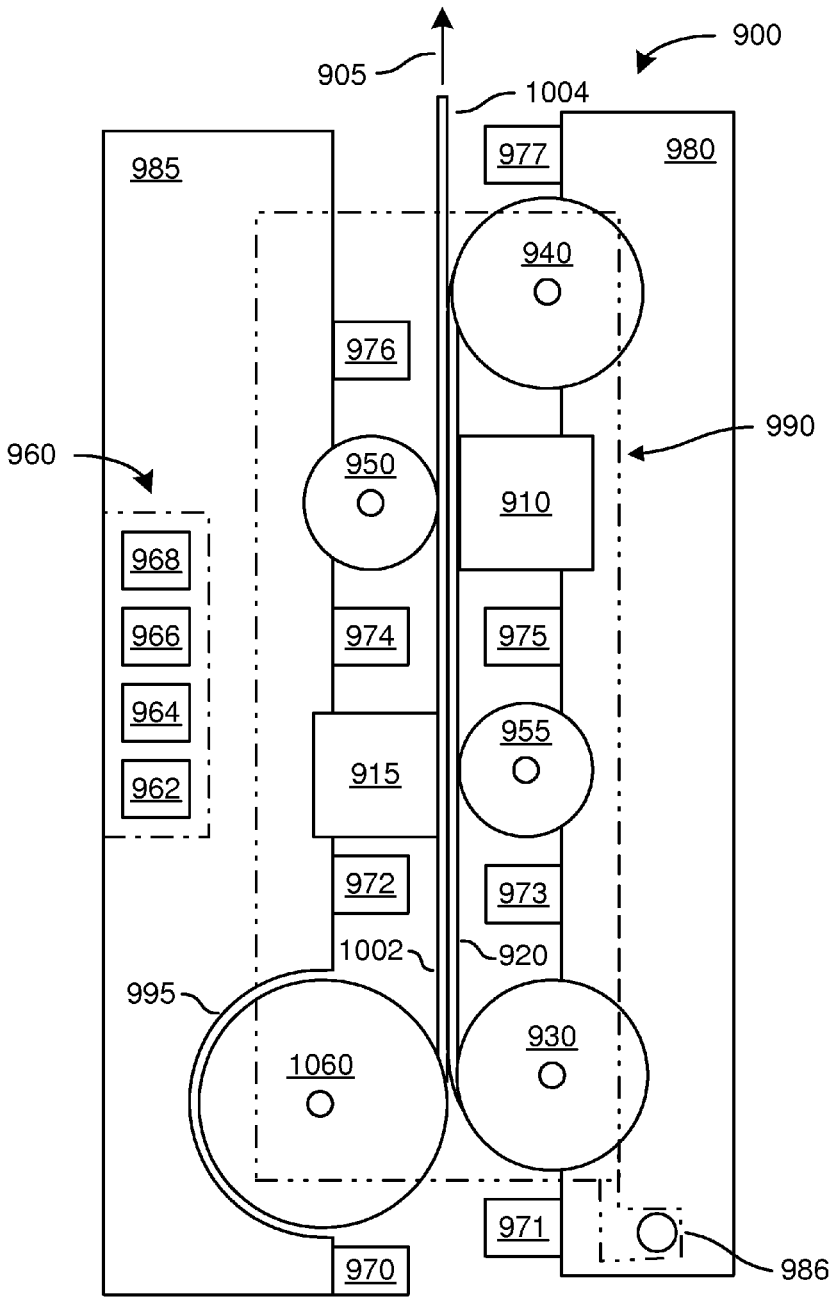
FIG. 9 provides a schematic of a combined two-sided direct thermal and thermal transfer printer.
Figure 10:
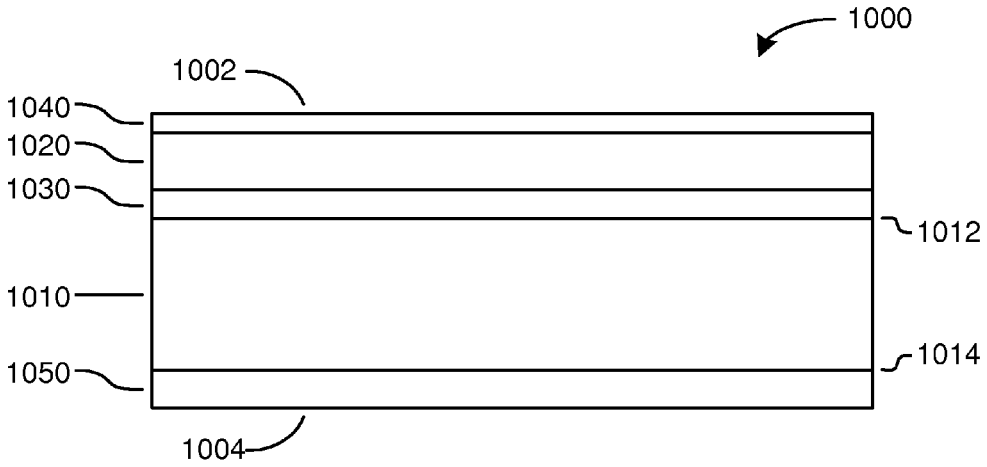
FIG. 10 provides a cross-sectional view of combined two-sided direct thermal and thermal transfer media for use as, inter alia, a transaction receipt, ticket, label, or other document.

FIG. 9 illustrates a combined two-sided direct thermal and thermal transfer printer 900 for combined direct thermal and thermal transfer printing of, inter alia, combined direct thermal and thermal transfer media 1000 as illustrated in FIG. 10. As shown in FIG. 9, a combined two-sided direct thermal and thermal transfer printer 900 may comprise first and second thermal print heads 910, 915 for printing on respective first and/or second sides 1002, 1004 of combined two-sided direct thermal and thermal transfer media 1000 moving along a media feed path 905. Additionally, first and second platens 950, 955 may be provided on opposite sides of the media 1000 and feed path 905 thereof proximate to the first and second print heads 910, 915 in order to, for example, maintain contact between the first and second print heads 910, 915 and a respective first and second side 1002, 1004 of the media 1000.

As shown in FIG. 10, combined two-sided direct thermal and thermal transfer media 1000 may comprise a substrate 1010 having a direct thermally sensitive coating 1020 on a first side 1012 thereof, and a thermal transfer receptive coating 1050 on a second side 1014 thereof. As for the one- or two-sided thermal transfer and/or direct thermal media 200, 300, 400, 500 illustrated in FIGS. 2, 3, 4, and 5, the substrate 1010 of combined two-sided direct thermal and thermal transfer media may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, a substrate 1010 is provided in the form of a starch based paper.

Likewise, a direct thermally sensitive coating 1020 and a thermal transfer receptive coating 1050 of a combined two-sided direct thermal and thermal transfer media 1000 may comprise any of the respective coatings 220, 320, 330, 420, 520, 550 discussed with regard to the one- or two-sided thermal transfer and/or direct thermal media 200, 300, 400, 500 illustrated in FIGS. 2, 3, 4, and 5 such as a direct thermally sensitive coating 1020 comprising a leuco-dye, developer and sensitizer, and a thermal transfer receptive coating 1050 comprising 90% clay and 10% PVA (as-dried).

As further illustrated in FIG. 10, combined two-sided direct thermal and thermal transfer media 1000 may further comprise a sub coat 1030, and a top coat 1040. Where provided, a sub coat 1030 may be included as a buffer region between a first surface 1012 of a substrate 1010 and a direct thermally sensitive coating 1020 to avoid adverse interaction of chemicals and/or impurities in the substrate 1010 with the direct thermally sensitive coating 1020, and thereby avoid undesired and/or premature imaging. Further, a sub coat 1030 may be provided to prepare an associated surface 1012 of a substrate 1010 for reception of a thermally sensitive coating 1020, such as by providing for a desired or required surface finish or smoothness. Suitable sub coats 1030 include clay and/or calcium carbonate based coatings as described with regard to FIGS. 4 and 5.

A top coat 1040 may be provided over a direct thermally sensitive coating 1020 to protect the thermally sensitive coating and/or any resultant image from mechanical (e.g., scratch, smudge, smear, and the like) and/or environmental (chemical, UV, and the like) degradation. Likewise, a top coat 1040 may be provided to enhance slip between the thermally sensitive coated side 1002 of the combined two-sided direct thermal and thermal transfer media 1000 and various components of a thermal printer such as, but not limited to a thermal print head. A top coat 1040 may include any suitable components that serve to protect or enhance the performance and/or properties of a thermally sensitive layer 1020 such as one or more polymers, monomers, UV absorbers, scratch inhibitors, smear inhibitors, slip agents, and the like, as also described with regard to FIGS. 4 and 5.

Depending on the printer design and/or application, print media such as the combined two-sided direct thermal and thermal transfer media 1000 of FIG. 10 may be supplied in the form of a roll 1060, fan-fold stock, individual (cut) sheets, and the like, upon which information in text and/or graphic form may be printed on one or both sides 1002, 1004 thereof to provide, for example, a voucher, coupon, receipt, ticket, label, or other article or document. It should be noted that it may be possible to direct thermally print on a first, direct thermally coated side 402, 502, 504 and thermally transfer print on a second, direct thermally coated or un-coated side 404, 504, 502 of one- or two-sided direct thermal media 400, 500 rather than on respective direct thermal and thermal transfer coated sides 1002, 1004 of combined direct thermal and thermal transfer media 1000, however thermal transfer print quality and/or longevity, and the like, may be affected.

As shown in FIG. 9, a combined two-sided direct thermal and thermal transfer printer 900 may additionally comprise a thermal transfer ribbon 920 for providing a functional, thermal transfer coating 120 for thermal transfer printing on a thermal transfer receptive side 1004 or a direct thermal coated side 1002 of combined, two-sided direct thermal and thermal transfer media 1000, or a side 202, 204, 302, 304, 404, 404, 502, 504 of one- or two-sided direct thermal or thermal transfer media 200, 300, 400, 500. Such ribbon 920 may be supported on supply 930 and take-up/rewind 940 reels or supports within the printer 900, which reels or supports may additionally maintain a desired or required tension of the ribbon 920 during a printer operation.

In further reference to FIG. 9, a combined two-sided direct thermal and thermal transfer printer 900 may also include first and second support arms 980, 985. The first support arm 980 may further be journaled on an arm shaft 986 to permit it to pivot or rotate in relation to the second support arm 985 in order to, for example, facilitate access to, and servicing of, the two-sided thermal transfer printer 900, including loading of media 1000, including a roll 1060 thereof, and/or a transfer ribbon 920 therein. In alternate embodiments, the first and second support arms 980, 985 may be in a fixed relation to one another.

As further illustrated in FIG. 9, a first thermal print head 910, a second platen 955, and first supply and take-up reels or supports 930, 940 may be coupled to or formed integrally with a first support arm 980, while a second thermal print head 915, a first platen 950, and a recess and/or support 995 for media 1000 or a roll 1060 thereof, may be coupled to or formed integrally with a second support arm 985. Variations are possible.

A combined two-sided direct thermal and thermal transfer printer 900 may further include a drive system 990 for transporting media, such as combined two-sided direct thermal and thermal transfer media 1000, and/or a thermal transfer ribbon 920 through the printer 900 during a print process. Depending on the design and/or application, a drive system 990 may comprise one or more motors (e.g. stepper, servo, and the like) (not shown) for powering a system of gears, links, cams, belts, wheels, pulleys, rollers, combinations thereof, and the like. In one embodiment, a drive system 990 comprising a series of individual stepper motors coupled to each of the respective first and second platens 950, 955 and supply and take-up/rewind reels 930, 940 is provided to transport media 1000 and/or thermal transfer ribbon 920 through the combined two-sided direct thermal and thermal transfer printer 900. Use of individual stepper motors provides for independent control over rotation of a given platen 950, 955 and/or supply and take-up reel 930, 940, allowing for, inter alia, control of tension of the media 1000 and/or thermal transfer ribbon 920. Such a drive system 990 would also allow for forward (e.g., pursuant to the arrow representing the media feed path 905) and/or backward (e.g., counter to the arrow representing the media feed path 905) feed of media 1000 and/or thermal transfer ribbon 920, thereby allowing for dual-direction and/or repetitive printing, and allowing for rewind and/or re-use of the thermal transfer ribbon 920. In alternate embodiments, a drive system 990 comprising a single stepper motor operatively connected the first and/or second platens 950, 955 and/or supply and/or take-up reels 930, 940, and/or one or more dedicated drive (e.g., non-platen) rollers (not shown), may be provided.

As shown in FIG. 9, a combined two-sided direct thermal and thermal transfer printer 900 may further include a controller 960 for controlling operation of the printer 900. Like the controller 760 of the two-sided direct thermal printer 700 of FIG. 7, and the controller 860 of the two-sided thermal transfer printer 800 of FIG. 8, the controller 960 of a combined two-sided direct thermal and thermal transfer printer such as the combined two-sided direct thermal and thermal transfer printer 900 of FIG. 9 may comprise a communication controller 962, one or more buffers or memory elements 964, a processor 966, and/or a printing function switch 968, each of which may perform one or more functions and/or operations consistent with the counterpart components 762, 764, 766, 768 of the two-sided direct thermal printer 700 of FIG. 7 described hereinabove.

Figure 11:
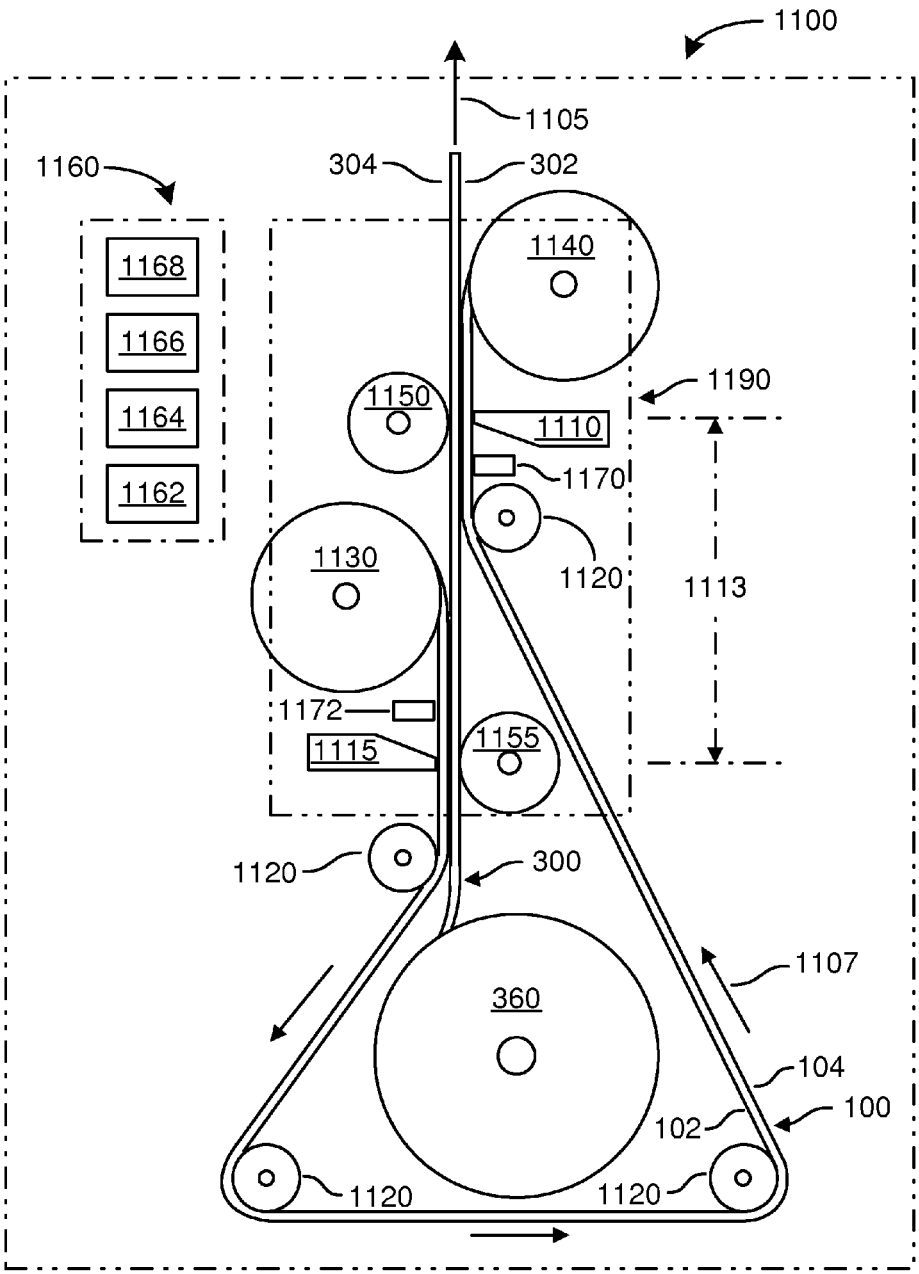
FIG. 11 provides a second schematic of a two-sided thermal transfer printer.

FIG. 11 illustrates a two-sided thermal transfer printer 1100 for thermal transfer printing of one- or two-sides of media such as any of the media 200, 300, 400, 500, 1000 of FIGS. 2, 3, 4, 5 and 10. As shown in FIG. 11, a two-sided thermal transfer printer 1100 may comprise first and second thermal print heads 1110, 1115 for printing on, for example, respective first and/or second sides 302, 304 of two-sided thermal transfer media 300 moving along a media feed path 1105.

As shown in FIG. 11, a two-sided thermal transfer printer 1100 may additionally comprise a single thermal transfer ribbon 100 comprising a single, functional thermal transfer coating 120 for thermal transfer printing of respective one- or two-sides of print media such as a first and a second side 302, 304 of two-sided thermal transfer media 300. Such ribbon 100 may be supported on supply 1130 and take-up/rewind 1140 reels or supports within the printer 1100, which reels or supports may additionally maintain a desired or required tension on the ribbon 100 during printer 1100 operation.

Additionally, a two-sided thermal transfer printer 1100 may include first and second platens 1150, 1155 on opposite sides 304, 302 of the media 300 and feed path 1105 thereof proximate to first and second print heads 1110, 1115 in order to, for example, maintain contact between the print heads 1110, 1115, print media 300, and thermal transfer ribbon 100.

Depending on the printer design and/or application, print media such as the one- or two-sided thermal transfer media 300 of FIG. 3 may be supplied in the form of a roll 360, fan-fold stock, individual (cut) sheets, and the like, upon which information in text and/or graphic form may be simultaneously or near simultaneously printed on one or both sides 302, 304 thereof to provide, for example, a one- or two-sided voucher, coupon, receipt, ticket, label, or other article or document. As previously noted, it may be possible to print on a side of media without a specific thermal transfer receptive coating, such as the back side 202 of the media 200 of FIG. 2, using a two-sided thermal transfer printer 1100, however print quality and/or longevity, and the like, may be affected.

A two-sided thermal transfer printer 1100 may further include one or more rollers 1120 for, inter alia, guiding thermal transfer media 300 and/or thermal transfer ribbon 100 along the respective media 1105 and ribbon 1107 feed paths through the printer 1100. Further, some or all of such rollers may additionally or alternatively provide means for transporting the ribbon 100 and/or media 300 through the printer 100, and/or maintain a desired tension of the ribbon 100 and/or media 300, alone or in combination with one or more of platens 1150, 1155, drive systems 1190, and the like.

As shown in FIG. 11, such rollers 1120 may also provide means for orienting a functional coated surface 102 of a thermal transfer ribbon 100 toward a printing surface 302, 304 of thermal transfer print media 300 for printing on both sides 302, 304 of such media 300 using a single thermal transfer ribbon 100.

As shown in FIG. 11, a two-sided thermal transfer printer 1100 may also include a drive system 1190 for transporting media, such as two-sided thermal transfer media 300, and/or thermal transfer ribbon 100 through the printer 1100 during a print process. Depending on the design and/or application, a drive system 1190 may comprise one or more motors (e.g. stepper, servo, and the like) (not shown) for powering a system of gears, links, cams, belts, wheels, pulleys, rollers, combinations thereof, and the like. In one embodiment, a drive system 890 comprising a stepper motor (not shown) and one or more gears (not shown) adapted to rotate one or both of a first and a second platen 1150, 1155 each provided in the form of a circular cylinder is provided to transport media 300 and ribbon 100 through the two-sided thermal transfer printer 1100. In alternate embodiments, a drive system 1190 comprising a stepper motor (not shown) operatively connected to one or more dedicated drive (e.g., non-platen) rollers (not shown), and/or one or both of the ribbon 100 supply 1130 and/or take-up 1140 rollers or supports may be provided.

A drive system 1190 may also provide means for lifting (e.g., moving substantially normal from a respective ribbon 100 and/or media 300 surface 102, 104, 302, 304) and/or laterally traversing (e.g., moving toward a side edge of a ribbon 100 or media 300 transverse to a media feed path 1105 or ribbon feed path 1107 direction) one or both print heads 1110, 1115 off of or away from the ribbon 100 and/or media 300. Such system 1190 may be required or desired in order to, for example, lift a print head 1110, 1115 off of a thermal transfer ribbon 100 and/or media 300 prior to advancing and/or rewinding a thermal transfer ribbon 100 and/or media 300 where such advance and/or rewind would otherwise result in the ribbon 100 and/or media 300 moving relative to each other (e.g., counter to one another and/or at different respective speeds in the same direction, and the like). In one embodiment, a drive system 1190 is adapted to lift a second print head 1115 off of a thermal transfer ribbon 100 prior to advancing the ribbon 100 and media 300 for further printing where a ribbon feed path 1107 direction is counter to a media feed path 1105 direction, as shown with regard to the second thermal print head 1115 of FIG. 11.

Suitable means for lifting and/or laterally traversing one or both print heads 1110, 1115 of a two-sided thermal printer such as the two-sided thermal transfer printer 1100 of FIG. 11 may include one or more motors, solenoids, screw-drives, linear-actuators, ratchets, springs, hydraulic and/or pneumatic cylinders, and the like.

It should be noted that lifting and/or laterally traversing of one or both print heads 1110, 1115 of a two-sided thermal printer such as the two-sided thermal transfer printer 1100 of FIG. 11 may also be employed to take a respective print head 1110, 1115 out-of-service in situations where, for example, such printer is used for single sided thermal printing or the respective print head 1110, 1115 is otherwise manually or automatically disabled from use as further discussed herein below.

In some embodiments, a two-sided thermal transfer printer 1100 may also include first and second support arms (not shown) for supporting some or all of the first and second print heads 1110, 1115, first and second platens 1150, 1155, and thermal transfer ribbon 100 supply 1130 and/or take-up rollers or supports 1140, which support arms may further be in fixed or pivotable relation to one another as illustrated in, and discussed in regard to, FIGS. 7, 8 and 9.

Likewise, a two-sided thermal transfer printer 1100 may further include a controller 1160 for controlling operation of the printer 1100. As described with regard to the two-sided direct thermal printer 700 of FIG. 7, the controller may comprising, inter alai, a communication controller 1162, one or more buffers or memory elements 1164, a processor 1166, and/or a printing function switch 1168, each of which may perform one or more functions and/or operations consistent with the counterpart components described with regard to FIG. 7 hereinabove.

Figure 12:
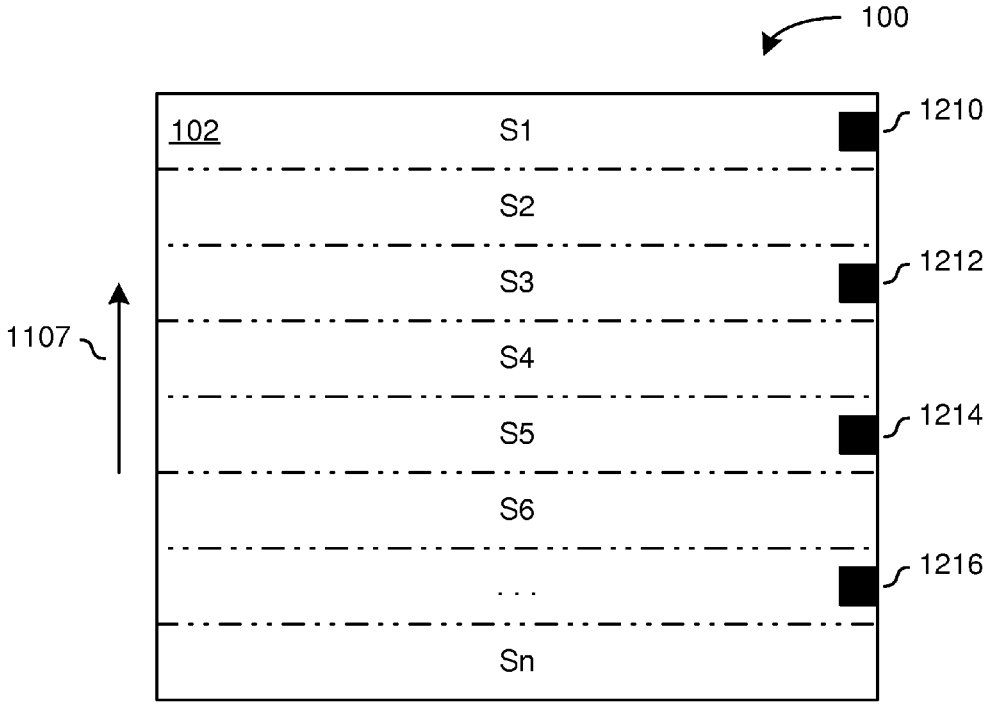
FIG. 12 provides a plan view of a thermal transfer coated side of a thermal transfer ribbon.

In addition, in one embodiment, a controller 1160 of a two-sided thermal transfer printer 1100 may be used to virtually segment a functional coat 120 of a thermal transfer ribbon 100 into uniform bands for printing on opposite sides of media such as a first and a second side 302, 304 of two-sided thermal transfer media 300. For example, as shown in FIG. 12, a functional coating 120 on a first side 102 of a thermal transfer ribbon 100 may be virtually segmented by a processor 1166 associated with a two-sided thermal transfer printer 1100 into odd and even numbered segments, S1, S2, S3, S4, S5, S6, and the like, such that printing on a first side 302 of media 300 occurs through use of odd numbered bands S1, S3, S5 of the functional coating 120, and printing of a second side 304 of media 300 occurs through use of even numbered bands S2, S4, S6 of the functional coating 120. Registration of the thermal transfer ribbon 100 with regard to the first and the second thermal print heads 1110, 1115 for printing with respective odd and even numbered bands may be provided through control over the lateral spacing 1113 of the print heads 1110, 1115, the length of ribbon 100 along the ribbon feed path 1107 between the print heads 1110, 1115, and/or the relative movement and/or displacement of the ribbon 100 with respect to the media 300 through use of a drive system 1190, among other means. Likewise, as further illustrated in FIG. 12, one or more sense marks 1210, 1212, 1214, 1216, may be provided on the ribbon 100 and/or media 300 (not shown) for control of relative or absolute ribbon 100 and/or media 300 location in concert with one or more sensors 1170, 1172 associated with a two-sided thermal transfer printer 1100. It should be noted the one or more sense marks 1210, 1212, 1214, 1216 may be provided on a first side 102 (as shown) and/or a second side 104 (not shown) of a thermal transfer ribbon 100, and/or utilized media 300 (not shown).

Figure 13:
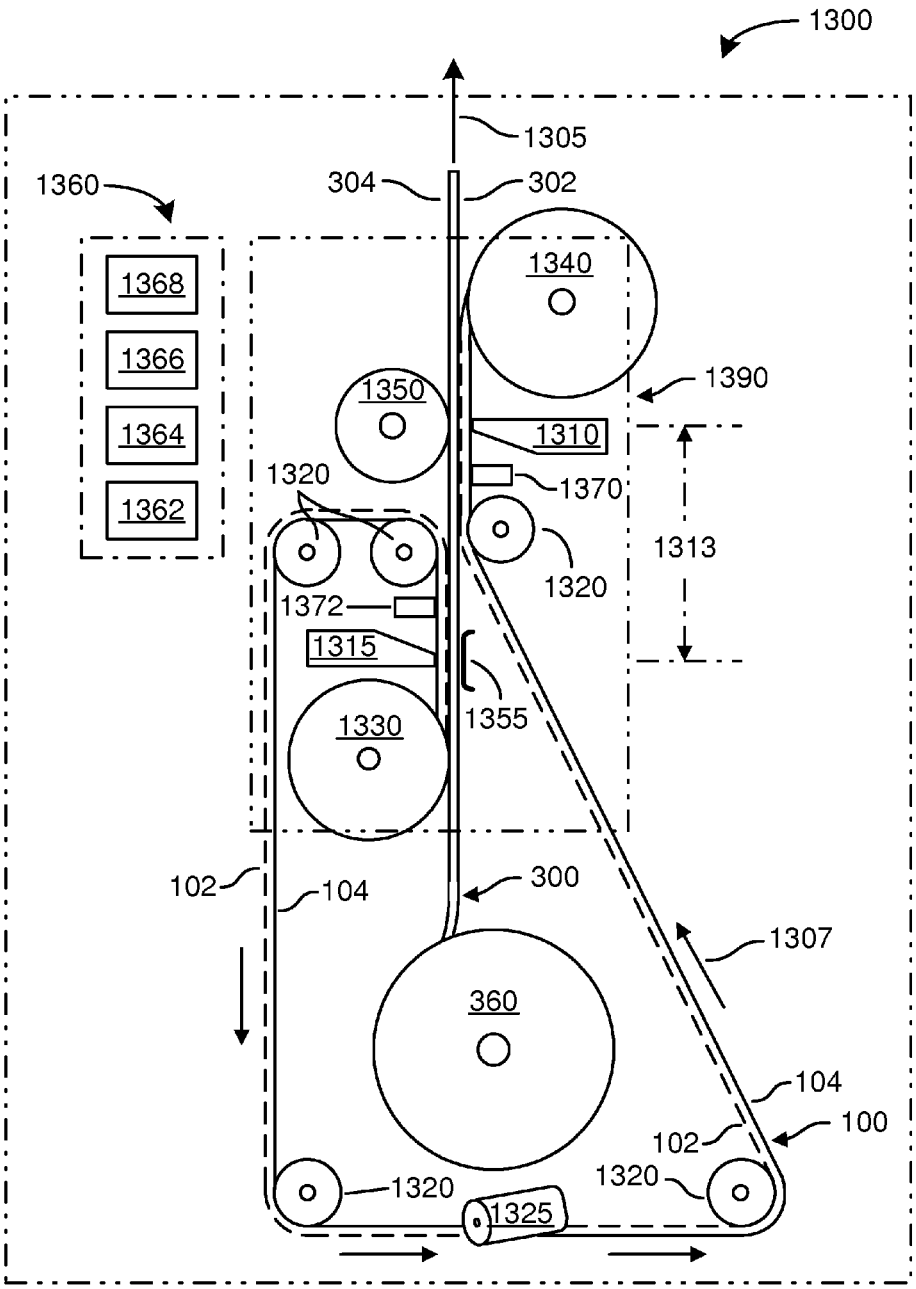
FIG. 13 provides a third schematic of a two-sided thermal transfer printer.

FIG. 13 illustrates a two-sided thermal transfer printer 1300 for thermal transfer printing of one- or two-sides of media such as any of the media 200, 300, 400, 500, 1000 of FIGS. 2, 3, 4, 5 and 10. As shown in FIG. 13, a two-sided thermal transfer printer 1300 may comprise first and second thermal print heads 1310, 1315 for printing on, for example, respective first and/or second sides 302, 304 of two-sided thermal transfer media 300 moving along a media feed path 1305.

As shown in FIG. 13, a two-sided thermal transfer printer 1300 may additionally comprise a single thermal transfer ribbon 100 comprising a functional thermal transfer coating 120 on a first side 102 thereof for thermal transfer printing of respective one- or two-sides of print media such as a first and a second media side 302, 304 of two-sided thermal transfer media 300. Such ribbon 100 may be supported on supply 1330 and take-up/rewind 1340 reels or supports within the printer 1300, which reels or supports may additionally maintain a desired or required tension on the ribbon 100 during printer 1300 operation.

Additionally, a two-sided thermal transfer printer 1300 may include first and second platens 1350, 1355 on opposite sides 304, 302 of the media 300 and feed path 1305 thereof proximate to first and second print heads 1310, 1315 in order to, for example, maintain contact between the print heads 1310, 1315, print media 300, and thermal transfer ribbon 100 during printer 1300 operation. As shown in FIG. 13, the first platen 1350 comprises a roller-type (e.g., cylindrical) platen while the second platen 1355 comprises a plate-type platen. As shown in FIG. 13, the plate-type platen 1355 may further include tapered leading and/or trailing edges to mitigate against damage to the media 300 and thermal transfer ribbon 100 as they traverse the platen.

Depending on the printer design and/or application, print media such as the two-sided thermal transfer media 300 of FIG. 3 may be supplied in the form of a roll 360, fan-fold stock, individual (cut) sheets, and the like, upon which information in text and/or graphic form may be printed on one or both sides 302, 304 thereof to provide, for example, a voucher, coupon, receipt, ticket, label, or other article or document.

A two-sided thermal transfer printer 1300 may further include one or more rollers or other guides 1320 for, inter alia, guiding thermal transfer media 300 and/or thermal transfer ribbon 100 along respective media and ribbon feed paths 1305, 1307 through the printer 1300. Additionally or alternatively, some or all of such rollers 1320 may provide means for transporting the ribbon 100 and/or media 300 through the printer 1300, and/or maintaining a desired tension of the ribbon 100 and/or media 300, alone or in combination with one or more supply 1330 and take-up/rewind 1340 reels or supports, platens 1350, 1355, drive systems 1390, and the like.

A drive system 1390 associated with a two-sided thermal transfer printer 1300 may provide for transportation of print media, such as the two-sided thermal transfer media 300 of FIG. 3, and/or thermal transfer ribbon, such as the thermal transfer ribbon 100 of FIG. 1, through the printer 1300 during printer operation. Depending on the design and/or application, a drive system 1390 may comprise one or more motors (e.g. stepper, servo, and the like) (not shown) for powering a system of gears, links, cams, belts, wheels, pulleys, rollers, combinations thereof, and the like, in operative contact with the media 300 and/or thermal transfer ribbon 100. In one embodiment, a drive system 1390 comprising a stepper motor (not shown) and one or more gears (not shown) adapted to rotate a first platen 1350 and one or more rollers 1320 each provided in the form of a circular cylinder is provided to transport media 300 and ribbon 100 through the two-sided thermal transfer printer 1300. In alternate embodiments, a drive system 1390 comprising a stepper motor (not shown) operatively connected to one or more dedicated drive (e.g., non-platen) rollers, such as any of the guide rollers 1320, and/or one or both of the ribbon 100 supply 1330 and/or take-up 1340 rollers or supports may be provided.

In alternate embodiments, a two-sided thermal transfer printer 1300 may also include first and second support arms (not shown) for supporting some or all of the first and second print heads 1310, 1315, first and second platens 1350, 1355, thermal transfer ribbon 100 supply 1330 and/or take-up rollers or supports 1340, any or all of the rollers 1320 used for, inter alia, guiding, feeding, and/tensioning the media 300 and/or thermal transfer ribbon 100, one or more turn bars 1325, and the like. Additionally, as illustrated in, and discussed in regard to, FIGS. 7, 8 and 9, where provided, the support arms may further be in fixed or pivotable relation to one another.

As additionally shown in FIG. 13, a two-sided thermal transfer printer 1300 may further include a controller 1360 for controlling operation of the printer 1300. As described with regard to the two-sided direct thermal printer 700 of FIG. 7, and the two-sided thermal transfer printer 1100 of FIG. 11, the controller 1360 may comprising, inter alai, a communication controller 1362, one or more buffers or memory elements 1364, a processor 1366, and/or a printing function switch 1368, each of which may perform one or more functions and/or operations consistent with the counterpart components described with regard to FIGS. 7 and 11 hereinabove, including providing for printing with alternating portions of a virtually or otherwise segmented thermal transfer ribbon 100 by a first and a second thermal print head 1310, 1315 of a two-sided thermal transfer printer 1300, which segmented printing may further employ one or more sensors 1370, 1372 associated with the printer 1300 for maintaining registration of the ribbon 100 with the media 300.

As shown in FIG. 13, a two-sided thermal transfer printer 1300 may further comprise one or more turn bars 1325 for turning a thermal transfer ribbon 100 such that a first side 102 thereof comprising a thermal transfer (functional) coating 120 appropriately faces first and second sides 302, 304 of print media 300 thereby allowing for thermal transfer printing by a respective first and a second thermal print head 1310, 1315 thereon. Such configuration permits use of one thermal transfer ribbon 100 for printing on both sides 302, 304 of print media 300, while providing for co-directional motion of the media 300 and ribbon 100, thereby reducing or eliminating slip and related issues such as, but not limited to, smudging and smearing of the functional coating 120 of the ribbon 100 on the media 300.

Figure 14:
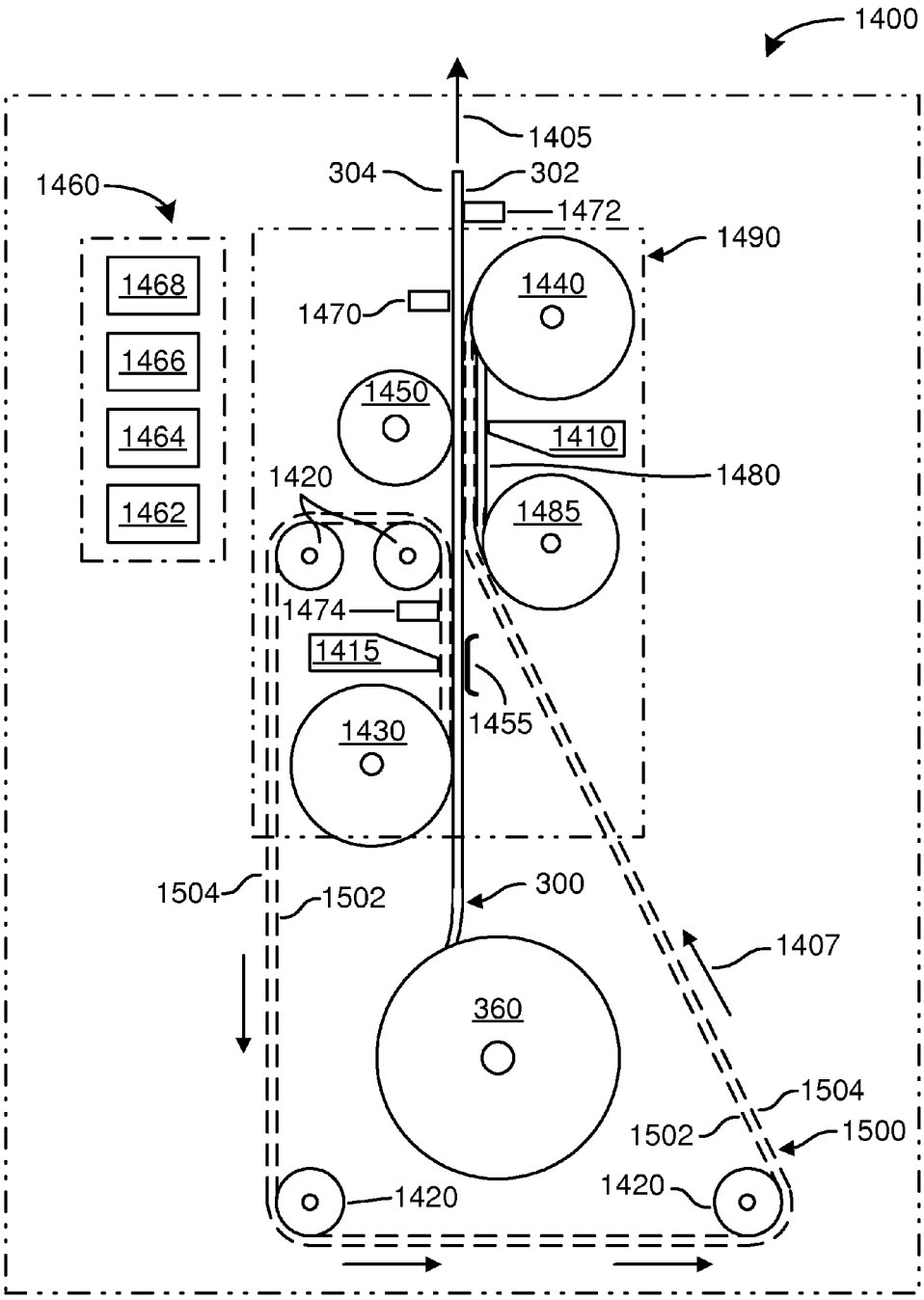
FIG. 14 provides a fourth schematic of a two-sided thermal transfer printer.

FIG. 14 illustrates a two-sided thermal transfer printer 1400 for thermal transfer printing of one- or two-sides of media such as any of the media 200, 300, 400, 500, 1000 of FIGS. 2, 3, 4, 5 and 10. As shown in FIG. 14, a two-sided thermal transfer printer 1400 may comprise first and second thermal print heads 1410, 1415 for printing on, for example, respective first and/or second sides 302, 304 of two-sided thermal transfer media 300 moving along a media feed path 1405.

Figure 15:
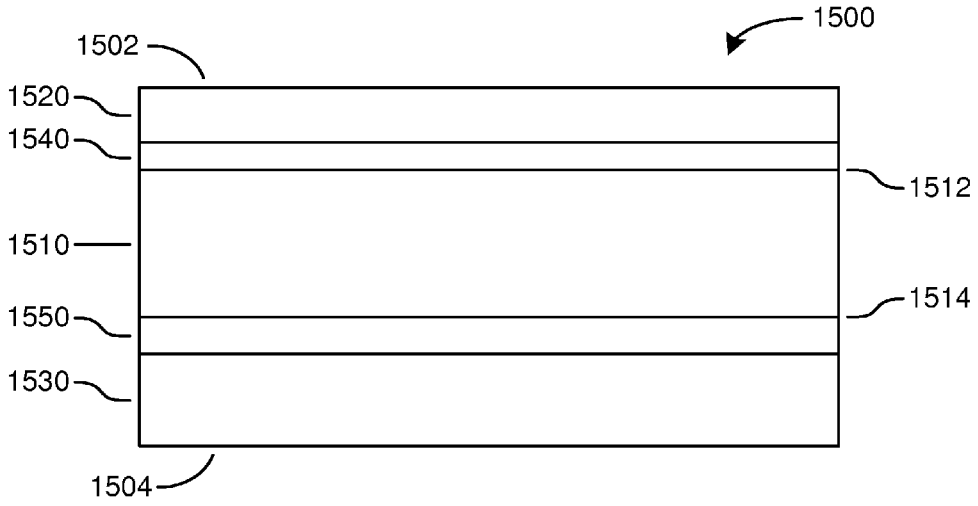
FIG. 15 provides a cross-sectional view of two-sided thermal transfer ribbon for, inter alia, thermal transfer printing of media such as transaction receipts, tickets, labels, and other documents.

As shown in FIG. 14, a two-sided thermal transfer printer 1400 may additionally comprise a two-sided thermal transfer ribbon 1500. As shown in FIG. 15, a two-sided thermal transfer ribbon 1500 may comprise a substrate 1510 with a first functional coat 1520 on a first side 1512 thereof, and a second functional coat 1530 on a second side 1514 thereof. A two-sided thermal transfer ribbon 1500 may be used for, inter alia, thermal transfer printing of respective sides of print media, such as a first and a second media side 302, 304 of two-sided thermal transfer media 300. A two-sided thermal transfer ribbon 1500 may be supported on supply 1430 and take-up/rewind 1440 reels or supports within the printer 1400, which reels or supports may additionally maintain a desired or required tension on the ribbon 1500 during printer 1400 operation.

The substrate 1510 of a two-sided thermal transfer ribbon 1500 may comprise a fibrous or film type sheet for supporting the functional coatings 1520, 1530. Additionally, the substrate 1510 may comprise one or more natural (e.g., cellulose, cotton, starch, and the like) or synthetic (e.g., polyethylene, polyester, polypropylene, and the like) materials. In order to control print quality resulting from a two-sided thermal transfer ribbon 1500, a predetermined material thickness, different from that of a single sided thermal transfer ribbon, may be necessary. In one embodiment, the substrate 1510 is provided in the form of a 20 gauge polyethylene terephthalate (PET) film.

One or more thermal barriers, primers, heat reflectors and or absorbers may also be desired or required as part of a two-sided thermal transfer ribbon 1500. Further, the functional coatings 1520, 1530 may be adapted to transfer at different temperatures (e.g., T1>T2) in order to, for example, avoid premature transfer of a first coating upon heating of the ribbon 1500 for transfer of a second coating, and vice-versa.

A functional coating 1520, 1530 of a two-sided thermal transfer ribbon 1500 may comprise a dye and/or pigment bearing substance which is transferred to receptive media (e.g., cardboard, paper, film, and the like) upon application of heat, by which printing is provided. A functional coating 1520, 1530 may comprise a wax (e.g., carnauba, paraffin, and the like), resin (e.g., urethane, acrylic, polyester, and the like), or a combination of the two, having one or more dyes (e.g., a leuco dye, methyl violet, and the like) and/or pigments (e.g., carbon black, iron oxide, inorganic color pigments, and the like) incorporated therein. In one embodiment, functional coatings 1520, 1530 comprising 65-85% carnauba and/or paraffin wax, 5-20% carbon black pigment, and 5-15% ethylene vinyl acetate (EVA) resin are provided. In a further embodiment, functional coatings 1520, 1530 comprising 40% carnauba, 40% paraffin wax, 15% carbon black pigment, and 5% ethylene vinyl acetate (EVA) resin are provided. Depending on the application, composition of the first and second functional coatings may be different. For example, in one embodiment, a wax based thermal transfer formulation may be provided on a first side 1502 of a two-sided thermal transfer ribbon 1500 and a resin based formulation may be provided on a second side 1504. Likewise, in some embodiments, a first functional coating 1520 may be selected to transfer (e.g., melt) at a different temperature than a second functional coating 1530 through, for example, selection of coating constituent materials, relative percentages thereof, additives, and the like.

As shown in FIG. 15, a two-sided thermal transfer ribbon 1500 may further comprise a sub coat 1540, 1550 between the substrate 1510 and either or both functional coatings 1520, 1530. Where provided, a sub coat 1540, 1550 may aid in adhering and/or releasing the functional coatings 1520, 1530 to and/or from the substrate 1510, and/or may protect the substrate 1510 from damage due to application of heat for printing (e.g., warping, curling, melting, burn-thru, and the like). A sub coat 1540, 1550 may comprise a wax (e.g., carnauba, paraffin, and the like), resin (e.g., urethane, acrylic, polyester, and the like), or a combination of the two, and may include one or more release and/or slip agents (e.g., polytetrafluoroethylene (PTFE), silicone, and the like). In one embodiment, a sub coat 1540, 1550 comprises 60% carnauba wax, 30% paraffin wax, and 10% PTFE. In another embodiment, a sub coat 1540, 1550 comprises a water based or ultra-violet (UV) light cured silicone. In some embodiments, the composition of a first sub coat 1540 is different from the composition of a second sub coat 1550.

As further shown in FIG. 14, a two-sided thermal transfer printer 1400 may include first and second platens 1450, 1455 on opposite sides 304, 302 of the media 300 and feed path 1405 thereof proximate to first and second print heads 1410, 1415 in order to, for example, maintain contact between the print heads 1410, 1415, print media 300, and thermal transfer ribbon 1500 during printer 1400 operation. As shown in FIG. 14, the first platen 1450 comprises a roller-type (e.g., cylindrical) platen while the second platen 1455 comprises a plate-type platen, although either or both platens may comprise rollers or plates. Where provided, a plate-type platen 1455 may further include tapered leading and/or trailing edges in order to mitigate against damage to the media 300 and thermal transfer ribbon 1500 as they traverses the platen 1455.

Depending on the printer design and/or application, print media such as the two-sided thermal transfer media 300 of FIG. 3 may be supplied in the form of a roll 360, fan-fold stock, individual (cut) sheets, and the like, upon which information in text and/or graphic form may be printed on one or both sides 302, 304 thereof to provide, for example, a voucher, coupon, receipt, ticket, label, or other article or document.

A two-sided thermal transfer printer 1400 may further include one or more rollers or other guides 1420 for, inter alia, guiding thermal transfer media 300 and/or thermal transfer ribbon 1500 along respective media and ribbon feed paths 1405, 1407 through the printer 1400. Additionally or alternatively, some or all of such rollers 1420 may provide means for transporting the ribbon 1500 and/or media 300 through the printer 1400, and/or maintaining a desired tension of the ribbon 1500 and/or media 300, alone or in combination with one or more supply 1430 and take-up/rewind 1440 reels or supports, platens 1450, 1455, drive systems 1490, and the like.

A drive system 1490 associated with a two-sided thermal transfer printer 1400 may provide for transportation of print media, such as the two-sided thermal transfer media 300 of FIG. 3, and/or thermal transfer ribbon, such as the two-sided thermal transfer ribbon 1500 of FIG. 15, through the printer 1400 during printer operation. Depending on the design and/or application, a drive system 1490 may comprise one or more motors (e.g. stepper, servo, and the like) (not shown) for powering a system of gears, links, cams, belts, wheels, pulleys, rollers, combinations thereof, and the like, in operative contact with the media 300 and/or thermal transfer ribbon 1500. In one embodiment, a drive system 1490 comprising a stepper motor (not shown) and one or more gears (not shown) adapted to rotate a first platen 1450 and one or more rollers 1420 each provided in the form of a circular cylinder is provided to transport media 300 and ribbon 1500 through the two-sided thermal transfer printer 1400. In alternate embodiments, a drive system 1490 comprising a stepper motor (not shown) operatively connected to one or more dedicated drive (e.g., non-platen) rollers, such as any of the guide rollers 1420, and/or one or both of the ribbon 100 supply 1430 and/or take-up 1440 rollers or supports may be provided.

As shown in FIG. 14, a two-sided thermal transfer printer 1400 comprising a two-sided thermal transfer ribbon 1500 may include one or more sacrificial surfaces or substrates 1480 for preventing a functional coating 1530 on a second side 1504 of a two-sided thermal transfer ribbon 1500 from building up on or otherwise contaminating a first thermal print head 1410 while heat is applied by such head to the ribbon 1500 for printing on a first side 302 of media 300. In one embodiment, a substrate 1480 is provided between a second surface 1504 of a two-sided thermal transfer ribbon 1500 and a first thermal print head 1410 such that any of the second functional coating 1530 released through application of heat by the first thermal print head is captured on the substrate 1480 and/or remains on the second side 1504 of the two-sided thermal transfer ribbon 1500. In such embodiment, the substrate 1480 may comprise a continuous sheet and/or film of media provided on a supply roll 1485 for co-feeding and take-up 1440 with a two-sided thermal transfer ribbon 1500 as such ribbon traverses the first thermal print head 1410. In some embodiments, a separate take-up reel or means (not shown) specific to the substrate may also be provided.

In an alternate embodiment, a sacrificial surface or substrate 1480 may comprise a continuous loop of sheet and/or film media or other material adapted to capture any of the second functional coating 1530 that is released by virtue of application of heat by the first thermal print head 1410. In such embodiment, cleaning means such as a brush, scrapper, and the like (not shown) may be provided to continuously clean the sacrificial surface or substrate 1480 for continuous use.

In a further embodiment, a sacrificial surface or substrate 1480 may comprise a fixed surface adapted to prevent transfer of a second functional coating 1530 from a second side 1504 of a two-sided thermal transfer ribbon 1500 from building up on or otherwise contaminating a first thermal print head 1410. In such embodiment, a sacrificial surface or substrate may comprise one or more low friction materials such as, but not limited to, silicone and/or polytetrafluoroethylene (PTFE), which provide a barrier between a first thermal print head 1410 and a second side 1504 of a two-sided thermal transfer ribbon 1500 such that any functional coating released (e.g., melted) by virtue of application of heat from the first thermal print head 1410 is maintained and/or pressed against the second side 1504 of the two-sided thermal transfer ribbon 1500 for a sufficient time after application of said heat such that the released functional coating 1530 cools and maintains attachment and/or reattaches to the second side 1504 of the two-sided thermal transfer ribbon 1500. Combination and/or variation of the above embodiments for avoiding build-up on and/or contamination of a first thermal print head 1410 with a function coating 1530 from a two-sided thermal transfer media 1500 are possible.

In alternate embodiments, a two-sided thermal transfer printer 1400 may also include first and second support arms (not shown) for supporting some or all of the first and second print heads 1410, 1415, first and second platens 1450, 1455, thermal transfer ribbon 1500 supply 1430 and/or take-up rollers or supports 1440, any or all of the rollers 1420 used for, inter alia, guiding, feeding, and/or tensioning the media 300 and/or thermal transfer ribbon 15, sacrificial media supply roll 1485, and the like. Additionally, as illustrated in, and discussed in regard to, FIGS. 7, 8 and 9, where provided, the support arms may further be in fixed or pivotable relation to one another.

As additionally shown in FIG. 14, a two-sided thermal transfer printer 1400 may further include a controller 1460 for controlling operation of the printer 1400. As described with regard to the two-sided direct thermal printer 700 of FIG. 7, and the two-sided thermal transfer printer 1100 of FIG. 11, the controller 1460 may comprising, inter alai, a communication controller 1462, one or more buffers or memory elements 1464, a processor 1466, and/or a printing function switch 1468, each of which may perform one or more functions and/or operations consistent with the counterpart components described with regard to FIGS. 7 and 11 hereinabove.

In operation, data received for printing by a two-sided direct thermal, two-sided thermal transfer, and/or combined two-sided direct thermal and thermal transfer printer 700, 800, 900, 1100, 1300, 1400 may be split and/or otherwise designated for printing by a first and/or a second print head 710, 720, 810, 815, 910, 915, 1110, 1115, 1310, 1315, 1410, 1415 prior to being provided to the two-sided printer by, for example, a printing function switch 768, 868, 968, 1168,

1368, 1468 associated with the two-sided printer, and/or an application program or print driver running on an associated host terminal or computer (not shown), and the like, as described in, for example, U.S. patent application Ser. No. 11/675,649 entitled "Two-Sided Thermal Print Switch" and filed on Feb. 16, 2007, and U.S. patent application Ser. No. 11/765,605 entitled "Two-Sided Print Data Splitting" and filed on Jun. 20, 2007, the contents of which are hereby incorporated by reference herein.

Depending on the printer and/or application, it may be desired or required to identify data for printing by a particular print head and/or print means based on a type of data provided. For example, where lines of text and/or character (e.g., ASCII, Kanji, Hanzi, Hebrew, Arabic, and the like) data are provided for printing, such data may preferentially be selected for printing by direct thermal means. Likewise, where graphic (e.g., raster, bitmap, vector, and the like) data is provided, such as a bar code, such data may be preferentially be selected or otherwise apportioned for printing by thermal transfer means.

In one embodiment, combined text and graphic data may be received by a communication controller 962 associated with a combined two-sided direct thermal and thermal transfer printer 900. As such data is received, it may be stored in one or more received data memory or buffer elements 964. Upon receipt of a end-of-page, transmission, transaction, or other like command, the stored data may then be apportioned for printing by one or both of the direct thermal 915 and/or thermal transfer 910 print heads based on a type of data provided by one or both of a processor 966 and/or printing function switch 968 associated with the printer 900. Stored text data may then be identified and selected for printing by the direct thermal print head 915 while stored graphic data may be identified and selected for printing by the thermal transfer print head 910, wherein being identified and selected for printing may comprise identifying an appropriate portion of the received print data as text data and storing such data in an respective text data memory region or buffer 964 for printing via a direct thermal print head 915, and identifying an appropriate portion of the received print data as graphic data and storing such data in a respective graphic data memory region or buffer 964 for printing via a thermal transfer print head 910. Alternately some or all of the received print data may be identified as graphic and/or text data in advance of its receipt by a combined two-sided direct thermal and thermal transfer printer 900, which data may then be stored in respective text and graphic data memory regions 964 for printing via respective direct thermal and thermal transfer print heads 915, 910 upon receipt.

Likewise, it may be desired or required to print a portion of received print data via one or more available means, such as one of a direct thermal and thermal transfer means, while it may be possible or permitted to print the balance of the such data via any available method, such as either or both of direct thermal and thermal transfer means. For example, in an embodiment, it may be desired or required to print received graphic data via thermal transfer means, while it may be permitted to print received text data via direct thermal and/or thermal transfer means. As such, in one embodiment, received graphic data may be designated for printing by, for example, a thermal transfer print head 910 associated with a combined two-sided direct thermal and thermal transfer printer 900, while received text data may be selected for printing by either or both of a direct thermal print head 915 and/or the thermal transfer print head 910 of the combined two-sided direct thermal and thermal transfer printer 900.

In some embodiments, a quantity of text data identified for printing via thermal transfer means along with any received graphic data is selected such that the combined thermal transfer printed text and graphic data occupies a similar length of media as the remaining quantity of text data, thereby providing for a nearly uniform split of received data for printing on a first media side (e.g., approximately one half) via thermal transfer means as for printing on a second media side (e.g., approximately one half) via direct thermal means. For example, as illustrated with regard to the receipt 600 of FIG. 6, a first portion of transaction information 620 in the form of text data may be identified for and printed on a first side 602 of, for example, combined two-sided direct thermal and thermal transfer media 1000 comprising the receipt 600 via direct thermal means, while a second portion of the transaction information 620 in the form of text data along with the discount offer 650 and bar code 660 is identified for and printed on a second side 604 of the combined two-sided direct thermal and thermal transfer media 1000 comprising the receipt 600, wherein the length of media 1000 occupied by the text information printed on the first side 602 of the receipt 600 is roughly equivalent to the length of media 1000 occupied by the text and graphic information printed on the second side 604 of the receipt 600.

Variations on and/or combinations of the above described methods for apportioning text and/or graphic data for printing by one or both of direct thermal and/or thermal transfer means, such as, for example, where some or all of received graphic and/or text data is identified for printing in advance of receipt by a combined direct thermal and thermal transfer printer 900 and the balance is identified as text and/or graphics by a processor 966 or printing function switch 968 associated with the printer 900, or particular graphic information (e.g., a header and/or store identifier 610 or corporate logo) is permitted to be printed along with text information 620 via direct thermal means while other graphic information (e.g., a bar code 660) is permitted to be printed via only thermal transfer means, are also possible.

In additional embodiments, a two-sided thermal transfer ribbon 1500 may be used for thermal transfer printing using one of two available functional coatings 1520, 1530, and then rewound, removed, and/or turned over, reinserted, and re-run for thermal transfer printing using the other of two available functional coatings 1530, 1520. Likewise, in some embodiments, a one- or two-sided thermal transfer ribbon 100, 1500 may be provided in cartridge form for, for example, operator convenience, and ease of loading. Where utilized, a cartridge may comprise supply 830, 835, 930, 1130, 1330, 1430 and/or take-up/rewind 840, 845, 940, 1140, 1340, 1440 reels or supports, rollers or other guides 1120, 1320, 1420 and/or a turn bar assembly 1325 as required or desired for a particular printer 800, 900, 1100, 1300, 1400 configuration.

In some embodiments, a thermal transfer printer such as any of the printers 800, 900, 1100, 1300, 1400 illustrated in FIGS. 8, 9, 11, 13, and 14 may include hardware, software and/or firmware executed on or via, for example, one or more of a processor 866, 966, 1166, 1366, 1466, and/or a printing function switch 868, 968, 1168, 1368, 1468, that identifies, tracks and/or otherwise recognizes a portion of a one- or two-sided thermal transfer ribbon 100, 1500 that has been used for printing, and a portion which has not. Such system may be used to control unwinding and/or rewinding of a one- or two-sided thermal transfer ribbon 100, 1500 to maximize use of functional coatings 120, 1520, 1530 associated with such ribbons. In one embodiment, one or more sensors 870, 871, 872, 873, 874, 875, 876, 877, 970, 971, 972, 973, 974, 975, 976, 977, 1170, 1172, 1370, 1372, 1471, 1472, 1474 may be used to identify portions of a one- or two-sided thermal transfer ribbon 100, 1500 have been used for printing and which portions have not such that the ribbon 100, 1500 may be appropriately unwound and/or rewound for utilizing the identified, unused portions. Likewise, in other embodiments, one or more sense marks 1210, 1212, 1214, 1216 may be provided on a one- or two-sided thermal transfer ribbon 100, 1500 for identifying and/or tracking portions of a ribbon 100, 1500 that have been used for printing and which portions have not, as well as permitting registration of the same with a first and/or a second print head, thereby facilitating unwinding and/or rewinding of the ribbon 100, 1500 for utilization of unused portions.

In some embodiments, lifting and/or traversing print heads off of and/or away from and edge of print media may be provided to decouple printing by a thermal transfer printer 800, 900, 1100, 1300, 1400 from motion of an associated thermal transfer ribbon 100, 1500. Such system may be required or desired where a thermal transfer ribbon moves relative and/or counter to print media for some or all its motion such as, for example, in the two-sided thermal transfer printer 1100 illustrated in FIG. 11, and/or where unwind and/or rewind of such ribbon is provided for as described hereinabove.

Further, in various embodiments, bowed rollers, web guides, improved tension control, nip rollers, and/or related, individual drive motors may be incorporated in a thermal transfer printer 800, 900, 1100, 1300, 1400 to mitigate problems associated with ribbon 100, 1500 distortion and/or wrinkling.

In still other embodiments, a two-sided thermal transfer and/or combined direct thermal and thermal transfer printer 800, 900, 1100, 1300, 1400 may be used to print both a removable label (e.g., a face sheet comprising one or more adhesives such as a pressure sensitive glue) and an associated label liner (e.g., a back sheet coated with one or more release agents such as silicone). For example, depending on the printer, direct thermal means may be used to preferentially print the label while thermal transfer means may be used to preferentially print the associated liner, and vice-versa, or thermal transfer means may be used to print both the label and liner portions, allowing for use of an otherwise disposable liner.

Figure 16:
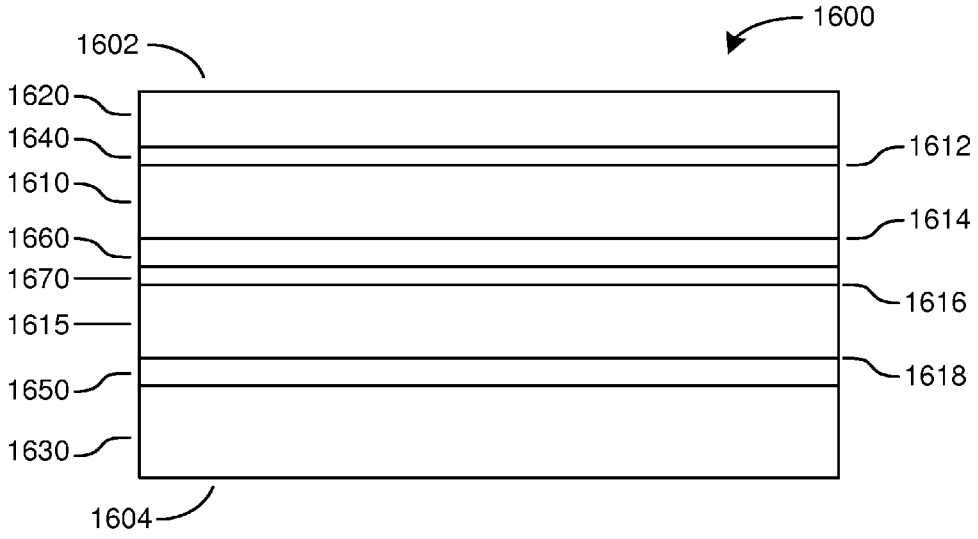
FIG. 16 provides a cross-sectional view of two-sided thermal media comprising a label and liner combination for, inter alia, two-sided direct thermal and/or thermal transfer printing thereof.

FIG. 16 illustrates a cross-sectional view of two-sided thermal media comprising a label and liner combination 1600 for printing by a two-sided thermal transfer and/or combined direct thermal and thermal transfer printer 800, 900, 1100, 1300, 1400. As shown in FIG. 16, the liner and label combination 1600 may comprise a first substrate 1610 having a first side 1612 and a second side 1614, and a second substrate 1615 having a first side 1616 and a second side 1618. Either or both of the substrates 1610, 1615 may comprise a fibrous or film type sheet each of which may further comprise one or more natural (e.g., cellulose, cotton, starch, and the like) and/or synthetic (e.g., polyethylene, polyester, polypropylene, and the like) materials. In one embodiment, first and second substrates 1610, 1615 of a label and liner combination 1600 are provided in the form of a non-woven cellulosic (e.g., paper) sheet.

As further shown in FIG. 16, the first substrate 1610 may include a thermally sensitive coating 1620 on at least a first side 1612 thereof. Where provided, a thermally sensitive coating 1620 may comprise a full, spot or pattern coating, and may provide for single or multi-color direct thermal printing therein. Further, a thermally sensitive coating 1620 may comprise at least one dye and/or pigment, and one or more activating agents, which undergo a color change upon the application of heat as described hereinabove.

As also shown in FIG. 16, the second substrate 1615 may include a thermal transfer receptive coating 1630 on a second side 1618 thereof. A thermal transfer receptive coating 1630 may comprise one or more materials for preparing a respective surface 1604 of the liner and label combination 1600 to accept transfer of a functional coating 120, 1520, 1530 from a thermal transfer ribbon 100, 1500 as described hereinabove.

In other embodiments, a label and liner combination 1600 may include a thermally sensitive coating 1620, 1630 or a thermal transfer receptive coating 1620, 1630 on a first side 1612 of a first substrate 1610 and a second side 1618 of a second substrate 1615 for, inter alia, two-sided direct thermal or two-sided thermal transfer printing of respective sides 1602, 1604 of the label and liner combination 1600.

In some embodiments, each of the first and/or second substrates 1610, 1615 of a label and liner combination 1600 may further include one or more base 1640, 1650 and/or top coats (not shown) associated with their respective first and/or second sides 1612, 1614, 1616, 1618. Where included, the one or more base 1640, 1650 and/or top coats may be respectively provided under and/or on top of one or more included thermally sensitive and/or thermal transfer receptive coatings 1620, 1630. Suitable materials for use as a base 1640, 1650 and/or top coat of a label and liner combination 1600 are as disclosed hereinabove.

As shown in FIG. 16, a liner and label combination 1600 may further comprise one or more adhesive layers 1660 for releasably attaching, inter alia, a second side 1614 of a first substrate 1610 to a first side 1616 of a second substrate 1615. Suitable adhesives include high tack adhesives for maintenance of residual tackiness or stickiness upon separation of the first and second substrates 1610, 1615, low tack adhesives which provide a low degree of residual tackiness or stickiness upon separation of the first and second substrates 1610, 1615, and/or no residual tack adhesives which leave no residual tackiness or stickiness upon separation of the first and second substrates 1610, 1615, and the like.

Additionally, and as shown in FIG. 16, the liner and label combination 1600 may further comprise one or more release layers or liners 1670 proximate to a first side 1616 of a second substrate 1615. Where provided, the one or more release layers or liners 1670 may assist in releasably attaching the first substrate 1610 to the second substrate 1615. Inclusion of a release layer or liner 1670 may vary with a type of adhesive 1660 used. For example, inclusion of a release layer or liner 1670 may be desired or required with use of a high tack adhesive 1660, but optional where a low and/or no tack adhesive 1660 is used.

In one embodiment, a high tack hot melt adhesive 1660 is applied to a second side 1614 of a first substrate 1610 having a thermally sensitive coating 1620 on a first side 1612 thereof, and a silicone release agent 1670 is applied to a first side 1616 of a second substrate 1615 having a thermal transfer receptive coating 1630 on a second side 1618 thereof such that, when removed from the second substrate 1615, the first substrate 1610 acts as a adhesive direct thermal label and the second substrate 1615 acts as a thermal transfer liner. In alternate embodiments, a silicone release agent 1660 is applied to a second side 1614 of a first substrate 1610 having a thermally sensitive coating 1620 on a first side 1612 thereof, and a medium tack pressure sensitive adhesive 1670 is applied to a first side 1616 of a second substrate 1615 having a thermal transfer receptive coating 1630 on a second side 1618 thereof such that, when removed from the second substrate 1615, the first substrate 1610 acts as a direct thermal liner and the second substrate 1615 acts as an adhesive thermal transfer label. Variations are possible.

In further embodiments, one or more sensors 770, 772, 774, 776, 778, 780, 870, 871, 872, 873, 874, 875, 876, 877, 970, 971, 972, 973, 974, 975, 976, 977, 1170, 1172, 1370, 1372, 1471, 1472, 1474 may be used to identify a type of media installed in a two-sided direct thermal and/or thermal transfer printer 700, 800, 900, 1100, 1300, 1400, wherein operation of one or more printer functions may further be controlled as a result of the media type determination. In one such embodiment, an attempt may be made to image or otherwise print a first and/or a second side of installed media, and one or more sensors may subsequently be used to determine the success or failure of such attempt through identifying whether the attempted image or print exists and/or meets a required or desired quality (e.g., contrast, missing data, etc). The result of such determination may be used to identify whether one or more required or desired coatings, such as one or more thermally sensitive and/or thermal transfer receptive coatings, are provided on respective first and/or second media sides, which information may then be communicated to an operator of a printer or associated host terminal, and/or be used by a controller 760, 860, 960, 1160, 1360, 1460 associated with a two-sided thermal printer 700, 800, 900, 1100, 1300, 1400 to control operation of one or more printer functions, such as limiting direct thermal printing to surfaces identified as having an appropriate thermally sensitive coating as described in, for example, U.S. patent application Ser. No. 11/644,262 entitled "Two-Sided Thermal Print Sensing" and filed on Dec. 22, 2006 the contents of which are hereby incorporated by reference herein.

In other embodiments, one or more sensors 770, 772, 774, 776, 778, 780, 870, 871, 872, 873, 874, 875, 876, 877, 970, 971, 972, 973, 974, 975, 976, 977, 1170, 1172, 1370, 1372, 1471, 1472, 1474 associated with a two-sided thermal printer 700, 800, 900, 1100, 1300, 1400 may be used to directly identify whether a required or desired coating or finish is provided on a first and/or a second media side absent a prior print attempt. For example, in one embodiment, one or more optical sensors may be used ascertain the reflectance of one or more media sides, which ascertained reflectance may be required to meet a predetermined reflectance correlating to a particular surface coating and/or smoothness prior to permitting direct thermal and/or thermal transfer printing thereon by an associated first and/or second thermal print head by, inter alia, a printing function switch 768, 868, 968, 1168, 1368, 1468 associated with a two-sided thermal printer 700, 800, 900, 1100, 1300, 1400.

Regardless of the technique, where a required or desired coating or surface finish for a particular print method (e.g., direct thermal or thermal transfer printing) is not found, printing via an associated thermal print head may be disabled. Additionally or alternately, existence of a required or desired coating or finish may be used as a condition precedent to enabling printing via one or more associated thermal print heads.

Additionally, in some embodiments, a first and a second thermal print head 710, 720, 810, 815, 910, 915, 1110, 1115, 1310, 1315, 1410, 1415 of a two-sided thermal printer 700, 800, 900, 1100, 1300, 1400 may operate at different temperatures (e.g., T1>T2), and/or may operate at any of a range of temperatures (e.g., T1, T2, T3, . . . Tn) and thereby be operated at different temperatures (e.g., Tn>T2). Such design or operation may be required or desired for imaging of, for example, one or more thermally sensitive coatings associated with a first and/or a second media side having different activation temperatures, and/or to print with a thermal transfer ribbon having one or more functional coatings which are adapted to be applied at one or more temperatures, and the like.

Figure 17:
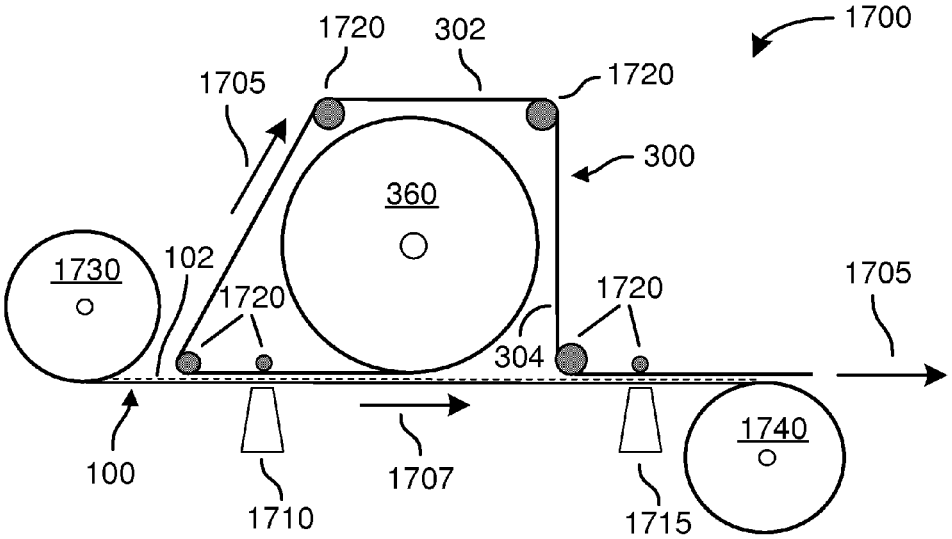
FIG. 17 provides a fifth schematic of a two-sided thermal transfer printer.

Further, in some embodiments, one- or two-sided thermal media 200, 300, 400, 500, 1600 may be rerouted in a two-sided thermal printer such that both sides 202, 204, 302, 304, 402, 404, 502, 504, 1602, 1604 thereof may be simultaneously or near simultaneously printed via respective ones of a first and a second thermal print head positioned on a same side of a direct thermal and/or thermal transfer printer. For example, as shown in FIG. 17, a media feed path 1705 of a two-sided thermal transfer printer 1700 may be oriented such that two-sided thermal transfer media 300 fed from a roll 360 thereof is routed to traverse a first thermal print head 1710 located on a first side of a thermal transfer ribbon 100 feed path 1707 using one or more rollers and/or platens 1720 to a second thermal print head 1715 located on the same (first) side of the ribbon feed path 1707 for near simultaneous thermal transfer printing of both a first and a second side 302, 304 of the media 300 via a functional coating 120 on a first side 102 of a single-sided thermal transfer ribbon 100 fed via respective feed 1730 and take-up 1740 rollers or supports (e.g., spindles).

Figure 18:
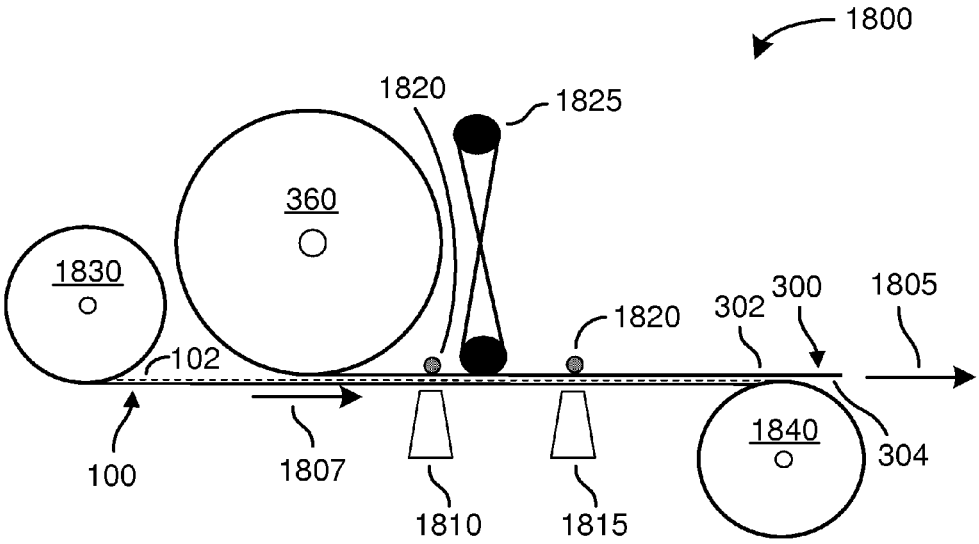
FIG. 18 provides a sixth schematic of a two-sided thermal transfer printer.

Alternately or additionally, as shown in FIG. 18, a media feed path 1805 of a two-sided thermal transfer printer 1800 may be oriented such that two-sided thermal transfer media 300 fed from a roll 360 thereof is routed to traverse a first thermal print head 1810 located on a first side of a thermal transfer ribbon 100 feed path 1807 using one or more rollers and/or platens 1820 and turn bars 1825 to a second thermal print head 1815 located on the same (first) side of the ribbon feed path 1807 for near simultaneous thermal transfer printing of both a first and a second side 302, 304 of the media 300 via a functional coating 120 on a first side 102 of a single-sided thermal transfer ribbon 100 fed via respective feed 1830 and take-up 1840 rollers or supports (e.g., spindles).

A controller (not shown) comprising one or more of a communication controller, one or more memory or buffer elements, a processor, and a printing function switch, as well as various sensors (not shown), as described hereinabove, may be provided with either or both of the two-sided thermal transfer printers 1700, 1800 of FIGS. 17 and 18. Likewise, in alternate embodiments, similar components and/or arrangements (e.g., media turning means comprising one or more rollers, platens, and/or turn bars for printing of two media sides by thermal print heads on a same printer side) may be used in a two-sided direct thermal printer and/or a combined two-sided direct thermal and thermal transfer printer, with or without associated controllers and sensors.

Further, in some embodiments, a first and a second thermal print head 710, 720, 810, 815, 910, 915, 1110, 1115, 1310, 1315, 1410, 1415 of a two-sided thermal printer 700, 800, 900, 1100, 1300, 1400 may directly oppose one another on opposite sides of a media and/or thermal transfer ribbon feed path such that a first thermal print head 710, 810, 910, 1110, 1310, 1410 acts as a platen for a second thermal print head 720, 815, 915, 1115, 1315, 1415 and vice-versa, as further described in U.S. patent application Ser. No. 11/678,216 entitled "Two-Sided Thermal Print Configurations" and filed on Feb. 23, 2007 the contents of which are hereby incorporated by reference herein.

The above description is illustrative, and not restrictive. In particular, designation of a first and a second print head, platen, gear, and the like, as well as a first and second media and/or thermal transfer ribbon sides, and the like, may vary among embodiments.

Further, many other embodiments will be apparent to those of skill in the art upon reviewing the above description. The scope of the embodiments should therefore be determined with reference to the appended claims, along with the full scope of equivalents to which such claims are entitled.

In the foregoing description of the embodiments, various features are grouped together in a single embodiment for the purpose of streamlining the disclosure. Likewise, various features are described only with respect to a single embodiment in order to avoid undue repetition. This method of disclosure is not to be interpreted as reflecting that the claimed embodiments should have more or less features than are expressly recited in each claim. Rather, as the claims reflect, inventive subject matter lies in more or less than all features of a single disclosed embodiment. Thus the claims are hereby incorporated into the description of the embodiments, with each claim standing on its own as a separate exemplary embodiment.

What is claimed is:

1. A two-sided thermal printer comprising:

a. a first thermal print head on a first side of a media feed path;

b. a second thermal print head on a second side of the media feed path, opposite the first side; and c. a first thermal transfer ribbon situated between the first thermal print head and the first side of the media feed path, wherein the first thermal transfer ribbon is adapted to apply a functional coating to a first media side upon activation of the first thermal print head;

d. wherein the first thermal transfer ribbon is further situated between the second thermal print head and the second side of the media feed path such that the first thermal transfer ribbon is additionally adapted to apply a functional coating to a second media side upon activation of the second thermal print head.

2. The two-sided thermal printer of claim 1, wherein the first thermal transfer ribbon is adapted to apply a functional coating from a first side thereof to both a first and a second media side upon activation of the respective first and second thermal print heads.

3. A method of operating a two-sided thermal printer comprising a first thermal print head on a first side of a media feed path and a second thermal print head on a second side of the media feed path, opposite the first side, the method comprising:

a. applying a functional coating from a first side of a first thermal transfer ribbon to both the first and the second sides of an installed media upon activation of the respective first and second thermal print heads.

4. The method of claim 3, wherein the applying step comprises:

a. inverting the first thermal transfer ribbon such that functional coating from the first side thereof may be applied to the second side of the installed media after functional coating is applied to the first side of the installed media.

5. The method of claim 4, wherein the installed media comprises a thermally sensitive coating on at least a second side thereof, the method further comprising:

a. imaging the thermally sensitive coating on the second side of the installed media upon activation of the second thermal print head.

6. The method of claim 5, wherein the installed media further comprises a thermal transfer receptive coating on at least a first side thereof, the method further comprising:

a. receiving functional coating from the first thermal transfer ribbon by the thermal transfer receptive coating on the first side of the installed media upon activation of the first thermal print head.

7. The method of claim 6, wherein the installed media comprises a first substrate and a second substrate, the first substrate including a thermal transfer receptive coating on at least a first side thereof, and the second substrate including a thermally sensitive coating on at least a first side thereof.

8. The method of claim 7, wherein a second side of the first substrate is removably attached to a second side of the second substrate.

9. The method of claim 8, wherein the first substrate further includes an adhesive on a second side thereof, and the second substrate further includes a release agent on a second side thereof.

10. The method of claim 8, wherein the second substrate further includes an adhesive on a second side thereof, and the first substrate further includes a release agent on a second side thereof.

11. The method of claim 3, further comprising:

a. identifying one or more regions of the first thermal transfer ribbon having functional coating remaining after a portion of the functional coating is applied to the first side of the installed media.

12. The method of claim 11, further comprising:

a. applying functional coating from at least one of the one or more identified regions to the second side of the installed media.

13. The method of claim 12, further comprising:

a. rewinding the first thermal transfer ribbon onto a ribbon feed spool; and b. applying functional coating from at least one of the one or more identified regions to the second side of the installed media.

14. The method of claim 13, further comprising:

a. moving the first and the second thermal print heads away from the installed media prior to rewinding the first thermal transfer ribbon onto the ribbon feed spool; and b. moving the first and the second thermal print heads toward the installed media prior to applying functional coating from at least one of the one or more identified regions to the second side of the installed media.

15. The method of claim 14, wherein moving the first and the second thermal print heads away from and toward the installed media comprises moving the first and the second thermal print heads in a direction substantially normal to a respective printing surface of the installed media.

16. The method of claim 14, wherein moving the first and the second thermal print heads away from and toward the installed media comprises moving the first and the second thermal print heads in a direction substantially transverse to a respective printing surface of the installed media.

17. The method of claim 3, further comprising:

a. moving one of the first and the second thermal print heads away from the installed media prior to advancing the media for printing; and b. moving the one of the first and second thermal print heads moved away from the installed media toward the installed media prior to printing of the media.

18. The method of claim 17, wherein moving one of the first and the second thermal print heads away from and toward the installed media comprises moving the one of the first and the second thermal print heads in a direction substantially normal to a respective printing surface of the installed media.

19. The method of claim 17, wherein moving one of the first and the second thermal print heads away from and toward the installed media comprises moving the one of the first and the second thermal print heads in a direction substantially transverse to a respective printing surface of the installed media.

* * * * *